US005542829A

United States Patent [19]

Inagaki et al.

[11] Patent Number: 5,542,829

[45] Date of Patent: Aug. 6, 1996

[54] SCROLL COMPRESSOR

[75] Inventors: Mitsuo Inagaki; Mikio Matsuda, both of Okazaki; Hiroshi Ogawa, Nukata-gun; Shigeru Hisanaga, Kariya; Yasuhiro Oki, Okazaki, all of Japan

[73] Assignees: Nippondenso Co., Ltd., Kariya, Japan; Nippon Soken, Inc., Nishio, Japan

[21] Appl. No.: 327,666

[22] Filed: Oct. 21, 1994

[30] Foreign Application Priority Data

Oct. 21, 1993 [JP] Japan ..... 5-263678
Sep. 22, 1994 [JP] Japan ..... 6-227967

[51] Int. Cl.[6] ..... F01C 1/04

[52] U.S. Cl. ..... 418/55.3; 464/103

[58] Field of Search ..... 418/55.3, 55.5; 464/102, 103, 106

[56] References Cited

U.S. PATENT DOCUMENTS

| | | | |
|---|---|---|---|
| 3,407,628 | 10/1968 | Eccher | 464/103 |
| 4,795,323 | 1/1989 | Lessie . | |
| 4,954,056 | 9/1990 | Muta et al. . | |
| 5,040,958 | 8/1991 | Arata et al. . | |
| 5,147,192 | 9/1992 | Suzuki et al. . | |
| 5,253,989 | 10/1993 | Shino et al. | 418/55.3 |
| 5,366,359 | 11/1994 | Bookbinder et al. . | |
| 5,391,065 | 2/1995 | Wolverton et al. | 418/55.3 |

FOREIGN PATENT DOCUMENTS

| | | |
|---|---|---|
| 3729319 | 3/1989 | Germany . |
| 3911882 | 10/1989 | Germany . |
| 57-203801 | 12/1982 | Japan . |
| 61-015276 | 4/1986 | Japan . |
| 62-199983 | 9/1987 | Japan . |

*Primary Examiner*—Charles Freay
*Attorney, Agent, or Firm*—Cushman, Darby & Cushman

[57] ABSTRACT

A self-rotation blocking mechanism in a scroll compressor having a movable scroll member and fixed scroll member fixed to a casing. The mechanism is constructed of circumferentially spaced opposing pairs of pins 9 and 10, which are connected to an end plate 12 of the movable scroll member 2 and a faced end wall of the casing 4, respectively, and which are in a side-by-side contacting relationship. The circumferential arrangement of the pins is such that, at every angular position of the movable scroll member, there exists at least one pair of the pins which generates a force in a direction opposite to a self-rotating torque applied to the movable scroll member caused by the compression reaction force. A locally concentrated arrangement of the pairs of the pins for generating such a force can be employed at the angular position which produces a larger value of self-rotating torque. Furthermore, the diameters of the pins are such that one half of the sum of the diameters is equal to or smaller than the radius of the orbital movement of the movable scroll member.

19 Claims, 27 Drawing Sheets

Fig. 4-A
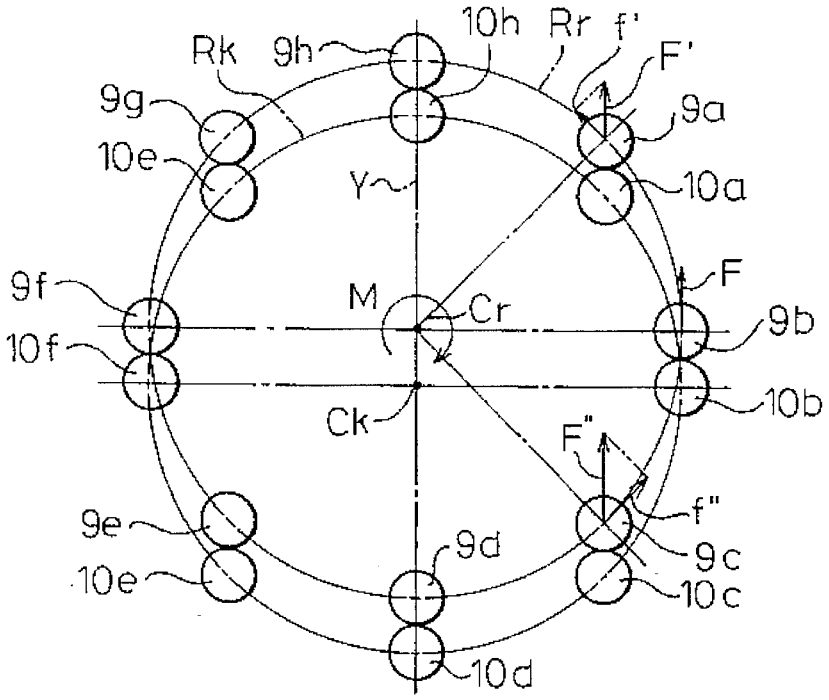
Fig. 4-B
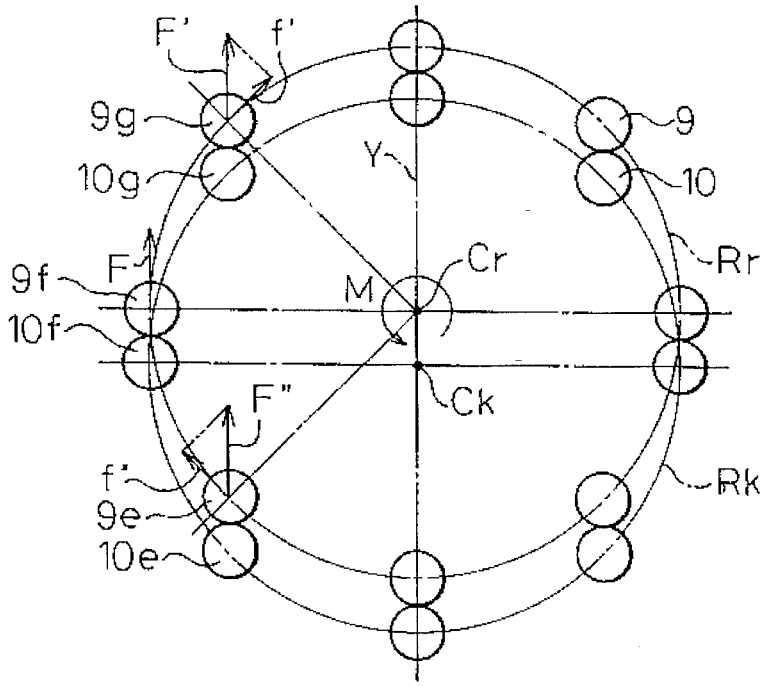

Fig.16-A
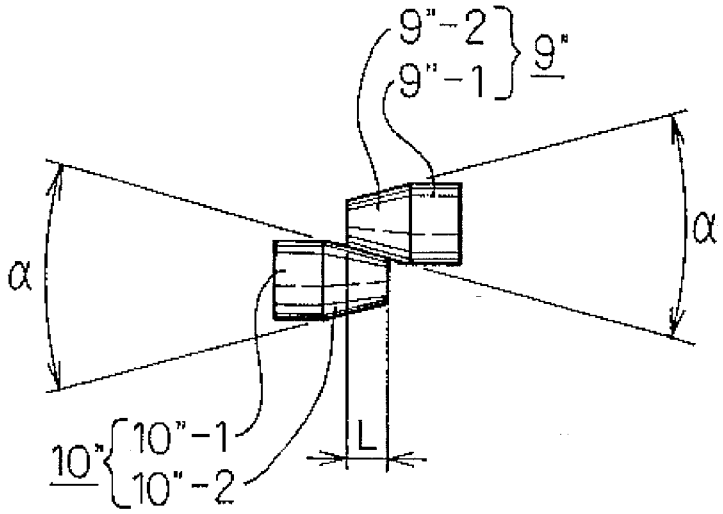
Fig.16-B
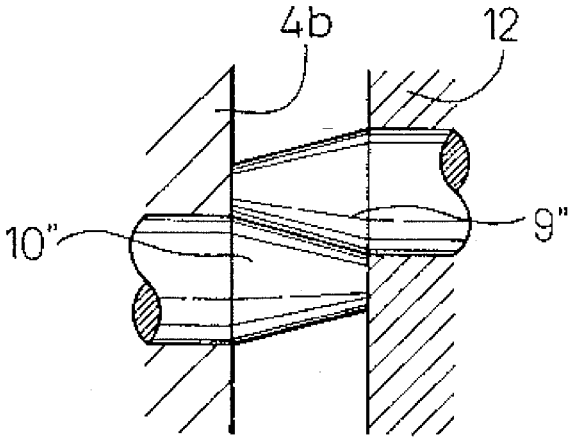

Fig.19-A
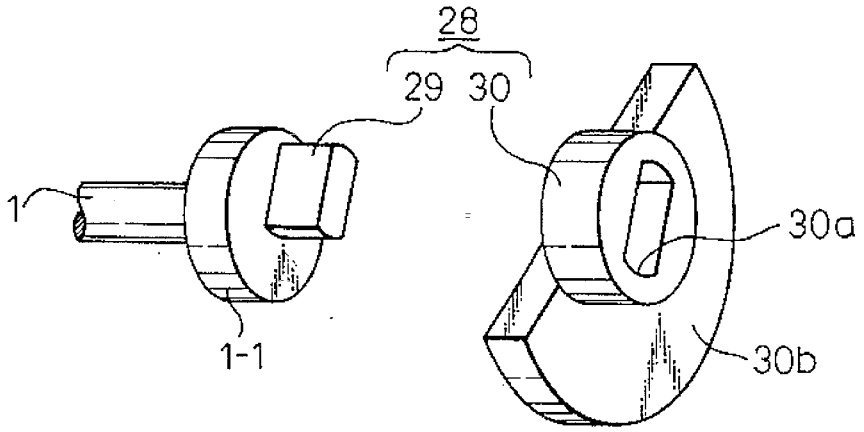
Fig.19-B
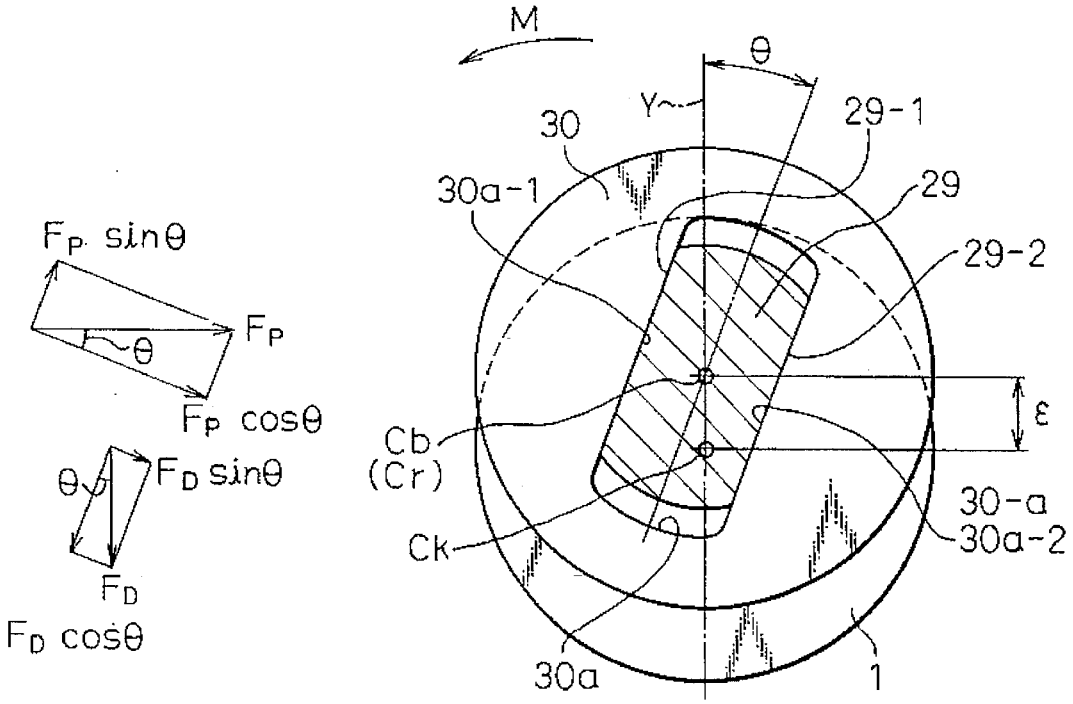

($\alpha$=180°)

($\alpha$=270°)

SCROLL COMPRESSOR

BACKGROUND OF THE INVENTION

1. Field of the Invention

The present invention relates to a scroll compressor used, for example, as a refrigerant compressor for an air conditioning system for an automobile. In particular, the present invention relates to a device for blocking self-rotating movement of a movable scroll member in a scroll compressor.

2. Description of Related Art

Well known scroll compressors include a casing, a drive shaft rotatably supported by the casing, a fixed scroll member fixed with respect to the casing and a movable scroll member which is movable with respect to the casing and which is arranged eccentric with respect to an axis of the drive shaft and is driven by the drive shaft. The fixed and movable scroll members are in a side-by-side relationship to create closed chambers. Means are also provided for blocking the rotational movement of the movable scroll member about its own axis, while allowing an orbital movement of the movable scroll member about the axis of the drive shaft. The closed chambers are displaced radially inwardly while their volume is reduced during the orbital movement of the movable scroll member. An intake introduces a medium to be compressed into the chamber when the chamber is radially outwardly located. An outlet discharges the medium as compressed from the chamber when the chamber is radially inwardly located. The means for blocking self rotation comprises a plurality of angularly spaced circular recesses formed on the end surface of the movable scroll member facing the casing and the end surface of the casing facing the end surface of the scroll member, respectively. The recesses on each of the opposing end surfaces are arranged axially opposite each other, so that equiangularly spaced pairs of recesses are created on the movable scroll member and the casing. A plurality of spherical members are supported between the axially opposed recesses in the respective pairs. This self rotation blocking mechanism is defective in that the construction is itself complicated, thereby increasing the number of the parts. Furthermore, the provision of circular recesses necessarily requires a larger area for the end surfaces of the casing and the movable scroll members, thereby increasing the size as well as the weight of the related parts. This mechanism does not allow for the size and weight of the compressor to be reduced, on one hand, or for the manufacturing cost to be reduced, on the other hand.

A scroll compressor has been proposed wherein, angularly spaced pairs of axially opposed recesses, between which spherical members are supported, are replaced by angularly spaced crank pins arranged between the opposed end surfaces of the casing and the movable scroll member, respectively, as disclosed in the specification of DE-OS 3729319. Furthermore, Japanese Unexamined Patent Publication No. 57-203801 discloses a scroll compressor having a self rotation blocking mechanism in which angularly spaced pins are rotatably supported by means of respective needle bearings on an end plate of the movable scroll member. The pins engage a ring shaped groove formed on the opposed end surface of the casing. Furthermore, Japanese Unexamined Patent Publication No. 60-199983 discloses a self rotation blocking device for a scroll compressor, which device includes a plurality of angularly spaced, axially opposed pairs of pins connected to the opposed end surfaces of the movable scroll member and the casing, respectively, and a common ring engaged with the opposed pins of each pair.

The self rotation blocking mechanisms disclosed in these references are also defective in that the size of the mechanism is increased.

SUMMARY OF THE INVENTION

An object of the present invention is to provide a self rotation blocking device in a scroll compressor, which overcomes the above mentioned drawbacks in the prior art.

Another object of the present invention is to provide a self rotation blocking device in a scroll compressor, which reduces the size and weight of the compressor and its production cost.

According to the present invention, a scroll compressor is provided which comprises:

a casing;

a drive shaft rotatably supported on the casing;

a fixed scroll member arranged in and fixed to the casing;

a movable scroll member movably arranged in the casing;

said scroll members having scroll portions which are arranged in a side-by-side relationship in a radial direction so that radially spaced chambers are created;

a crank member which is connected to the drive shaft at a location spaced from an axis of the drive shaft;

the movable scroll member being connected rotatably to the crank member, so as to obtain an orbital movement of the movable scroll member about the axis of the drive shaft, so that said radially spaced chambers move radially inwardly, while volumes of the chambers are reduced;

inlet means for introducing a medium to be compressed into a radially outwardmost one of the chambers;

outlet means for discharging the medium, as compressed, from a radially innermost one of the chambers;

a plurality of circumferentially spaced first pins mounted on the movable scroll member, so that the first pins extend axially away from the scroll portion, and;

a plurality of circumferentially spaced second pins mounted on the casing extending axially toward the movable scroll member;

the dimensions of the first and second pins with respect to the radius of the orbital movement of the movable scroll member being such that the first and second pins are capable of being in side by side contact, while the first pins are rotated about the respective second pins during the orbital movement of the movable scroll member, each of the first pins being unrestricted in movement in a direction radially away from an associated one of the second pins;

the arrangement of the first and second pins, on the movable scroll member and the casing respectively, is such that there exists, at every angular position of the movable scroll member, at least one pair of first and second pins which generates a force in a direction opposite to a direction of self rotation of the movable scroll member, thereby preventing the movable scroll member from being rotated about its own axis.

According to the present invention, the self rotation blocking mechanism is constructed only of circumferentially spaced pairs of pins connected to the end surface of the movable scroll member and the inner end surface of the casing facing the movable scroll member. The pins in the respective pairs are merely in side by side contact. Thus, the construction is very simple, due to the fact that no special means, such as grooves, holes, rings or bearing members are necessary for causing the pins to cooperate. Furthermore, the space occupied by the self rotation blocking mechanism and the weight of the compressor are reduced, thereby reducing production costs.

BRIEF EXPLANATION OF ATTACHED DRAWINGS

FIG. 4-A illustrates an operation of the self rotation blocking mechanism of the first embodiment of the present invention in a clockwise direction of self rotating torque.

FIG. 4-B is similar to FIG. 4-A, but illustrates an operation of the self rotation blocking mechanism in a counter clockwise direction of self rotating torque.

Figure 1:
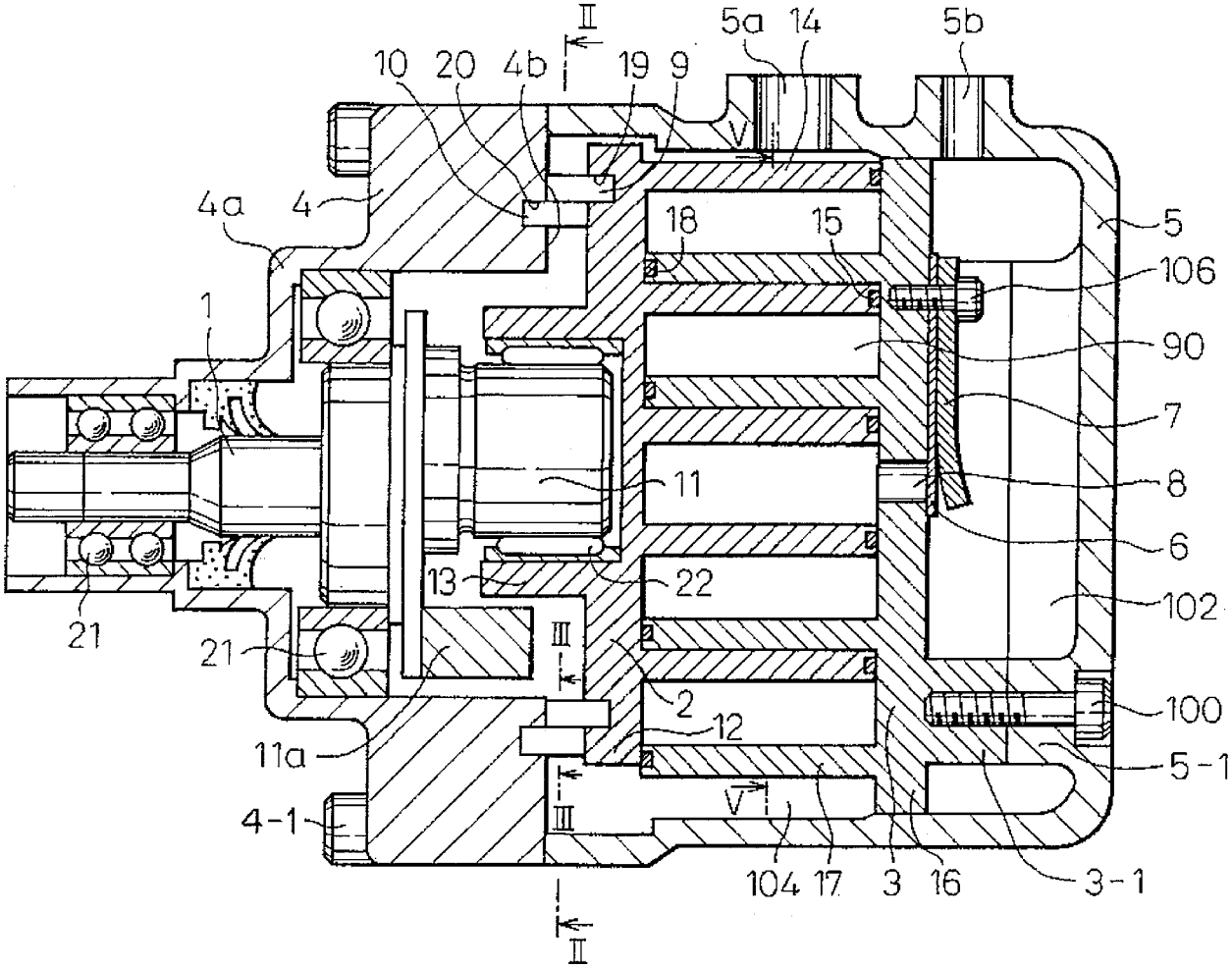
FIG. 1 is a longitudinal cross-sectional view of a scroll compressor according to the present invention.
Figure 5:
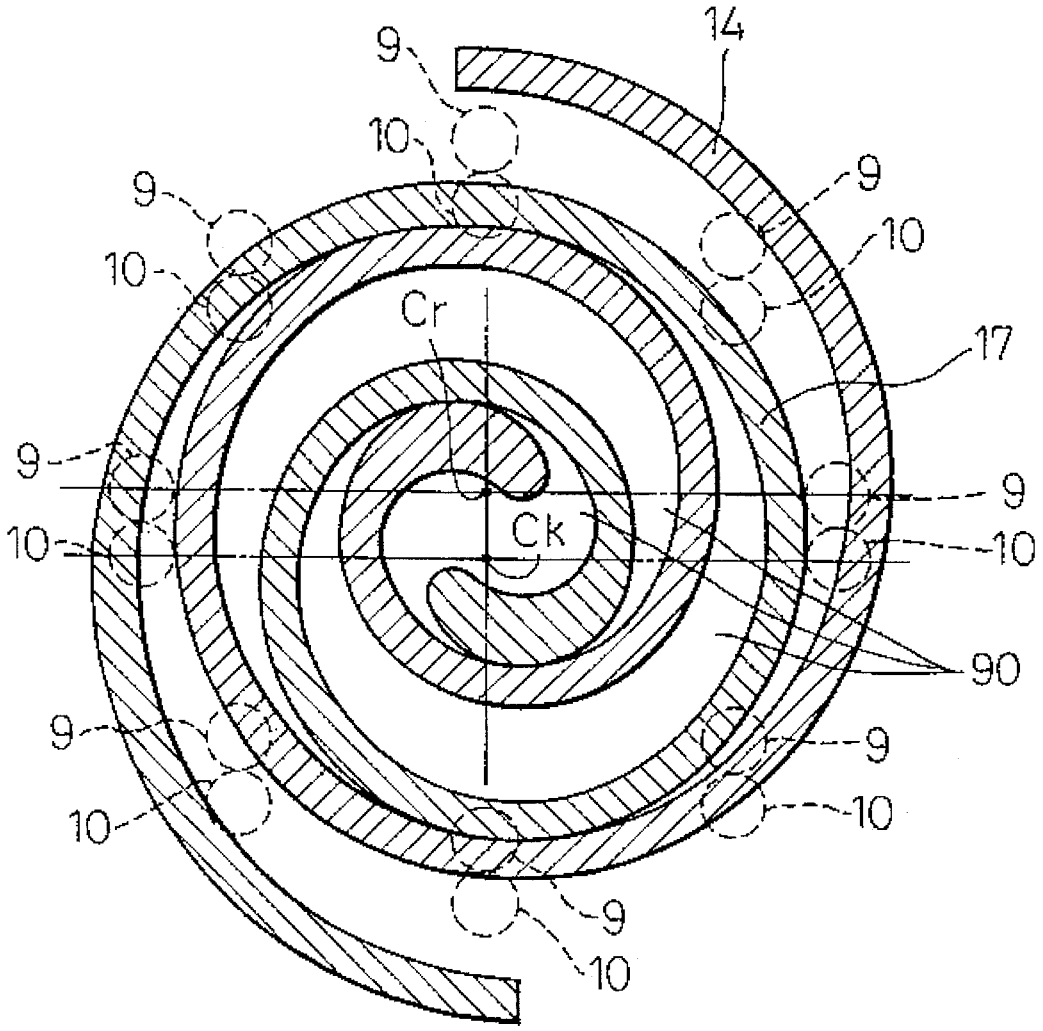

FIG. 5 is a cross-sectional view taken along a line V—V in FIG. 1.

Figure 3:
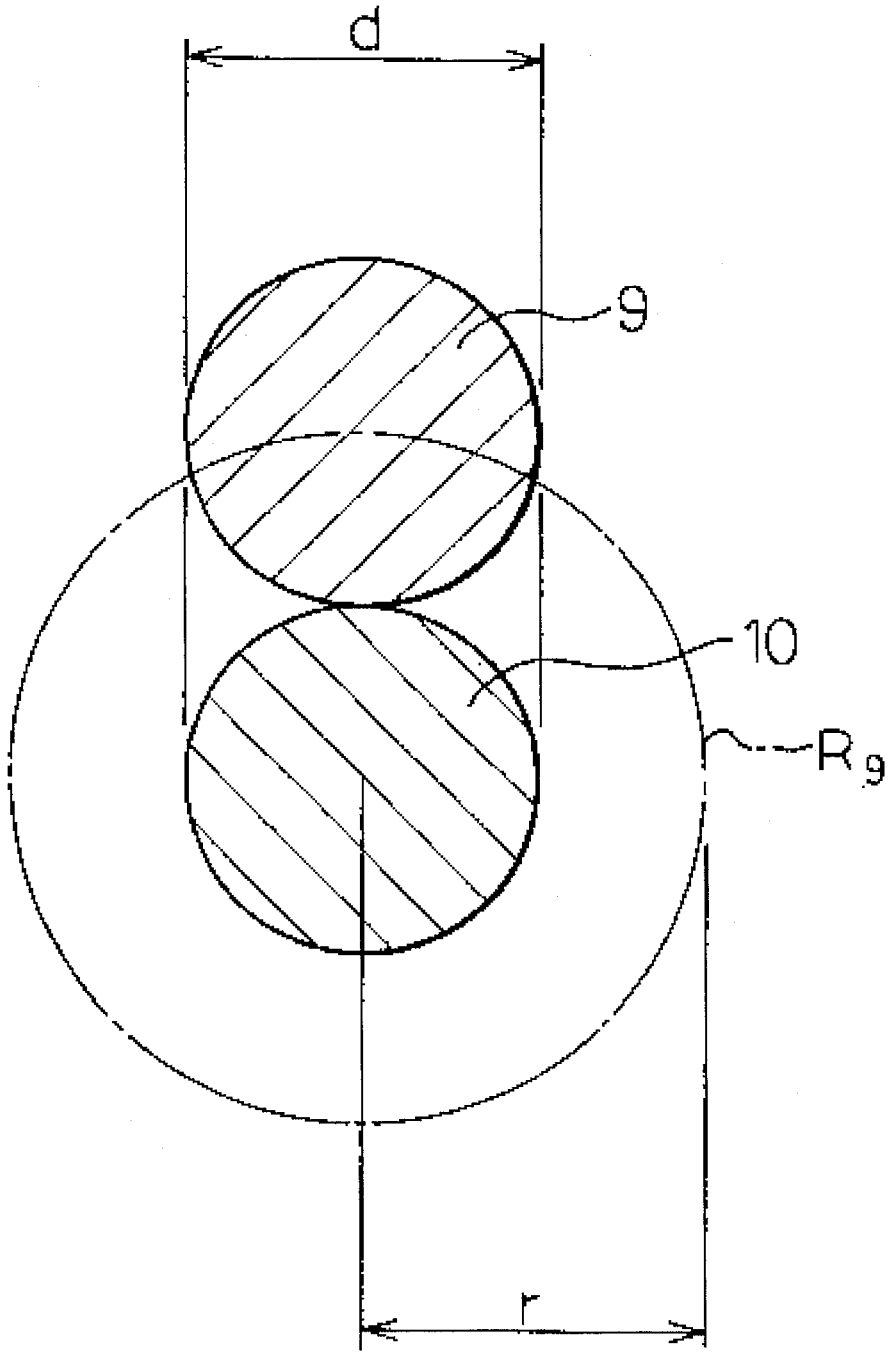
FIG. 3 is an enlarged cross-sectional view taken along a line III—III in FIG. 1.
Figure 6:
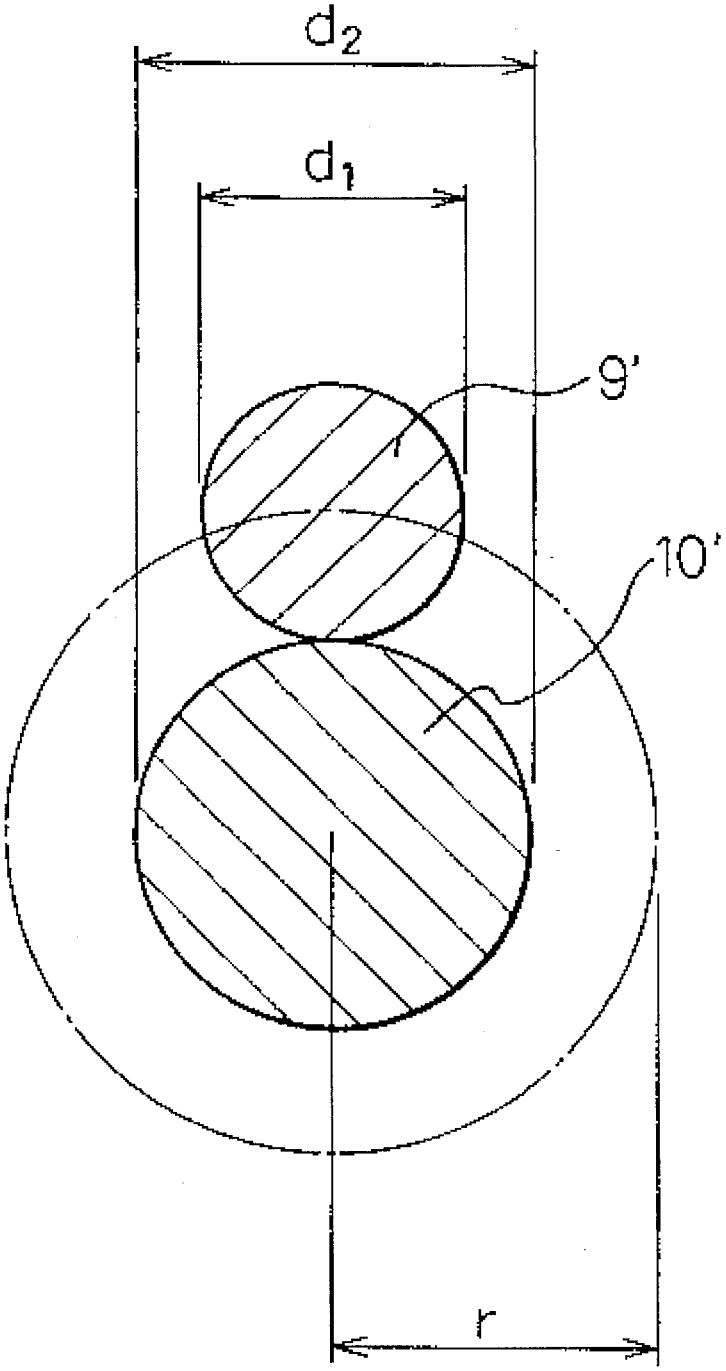

FIG. 6 is similar to FIG. 3, but illustrates a modification of the present invention.

Figure 7:
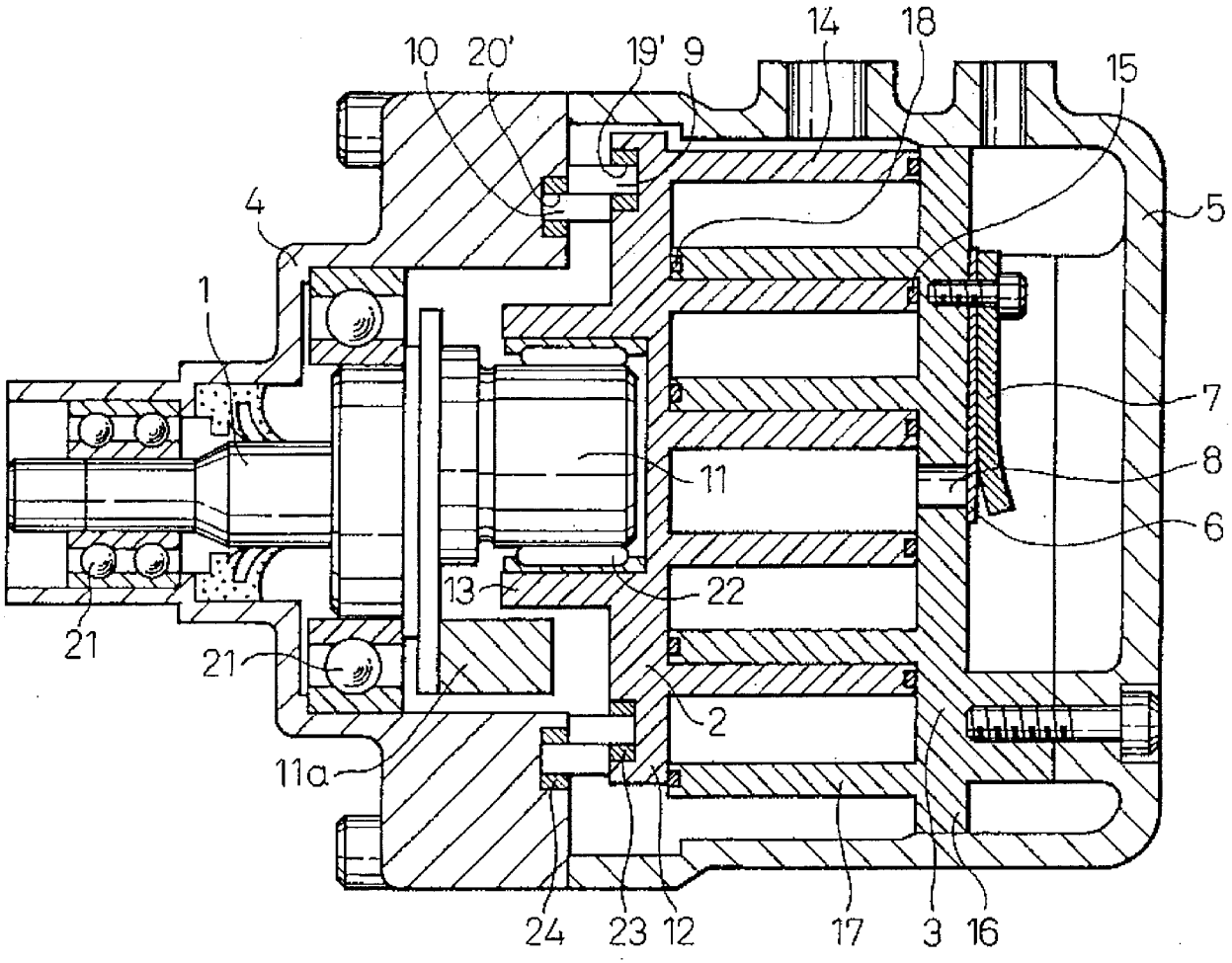

FIG. 7 is a longitudinal cross-sectional view of a scroll compressor according to a third embodiment of the present invention.

Figure 8:
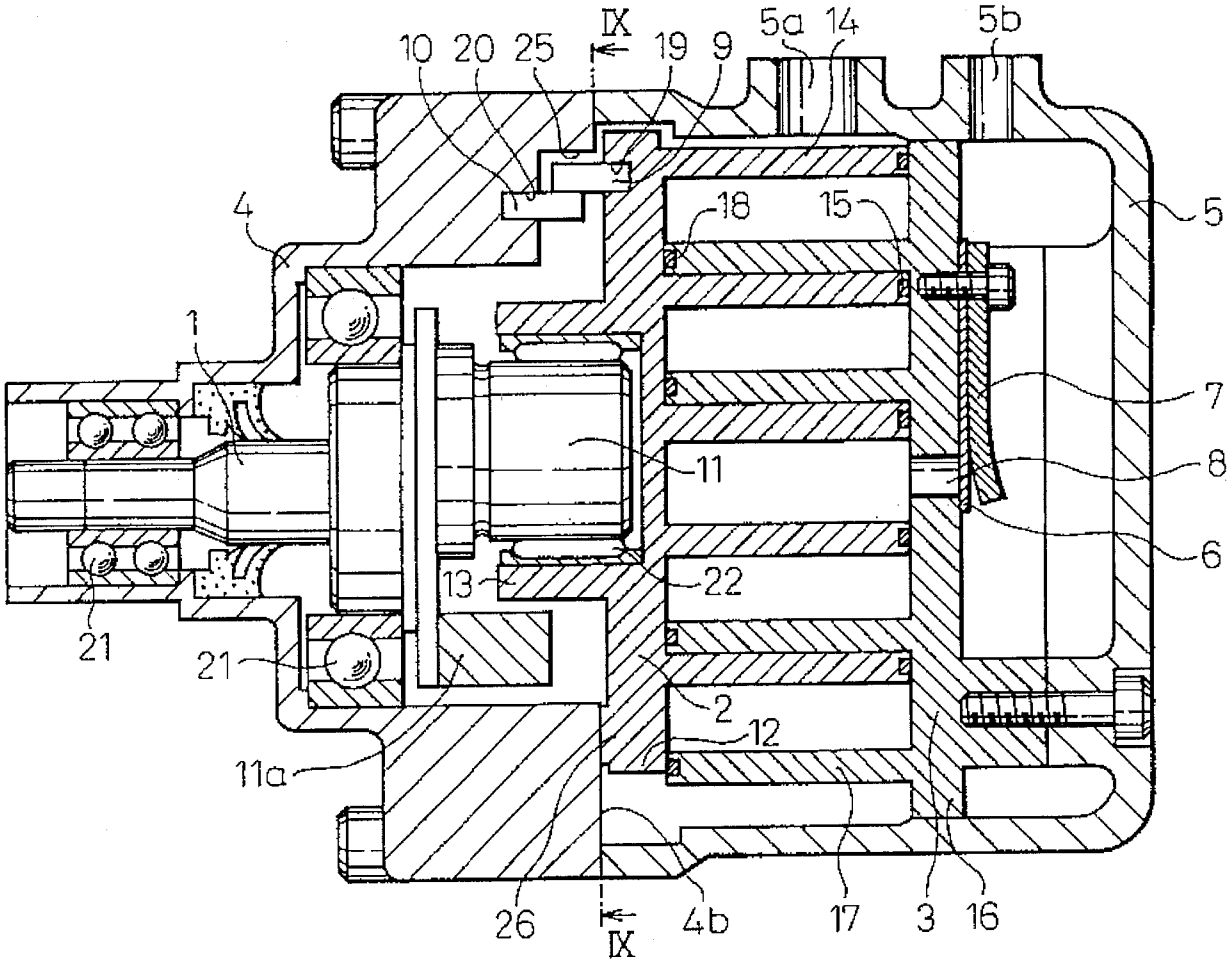

FIG. 8 is a longitudinal cross sectional view of a scroll compressor in a fourth embodiment.

Figure 9:
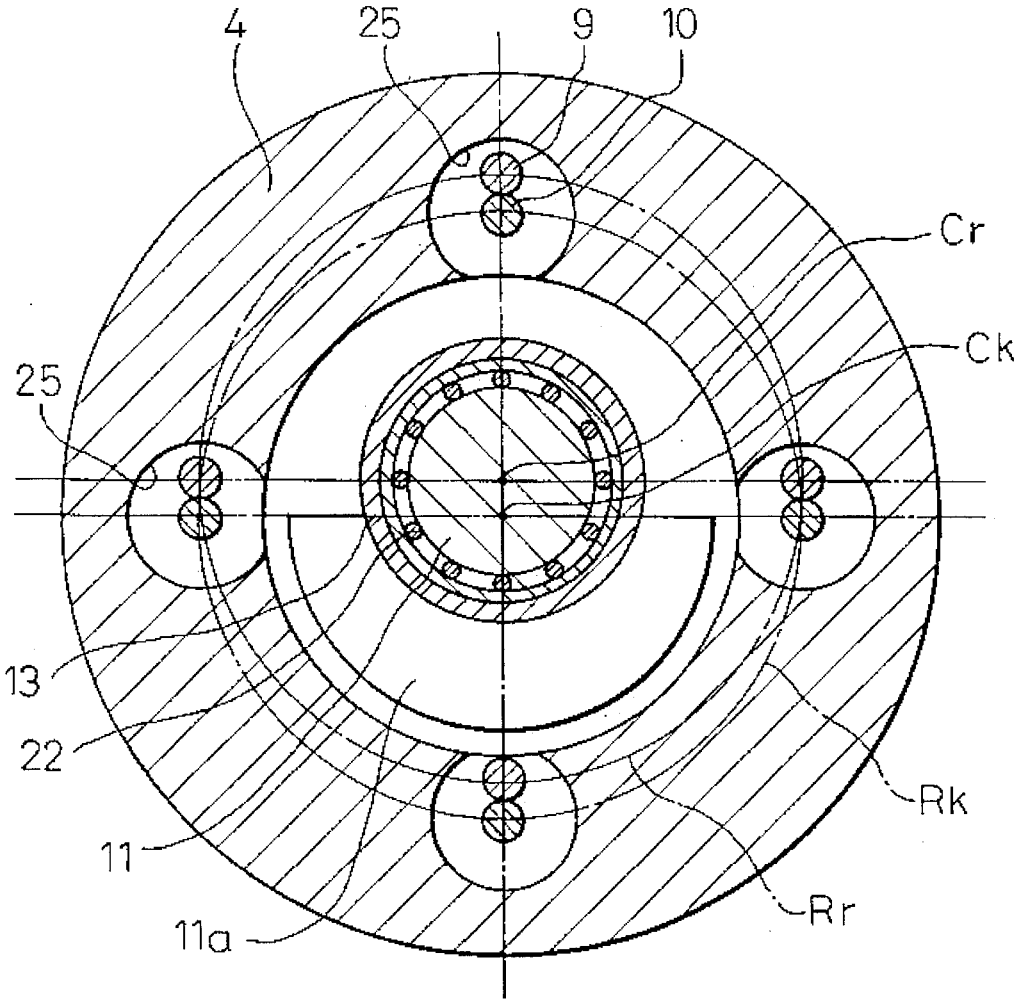

FIG. 9 is a cross-sectional view taken along a line IX—IX in FIG. 8.

Figure 10:
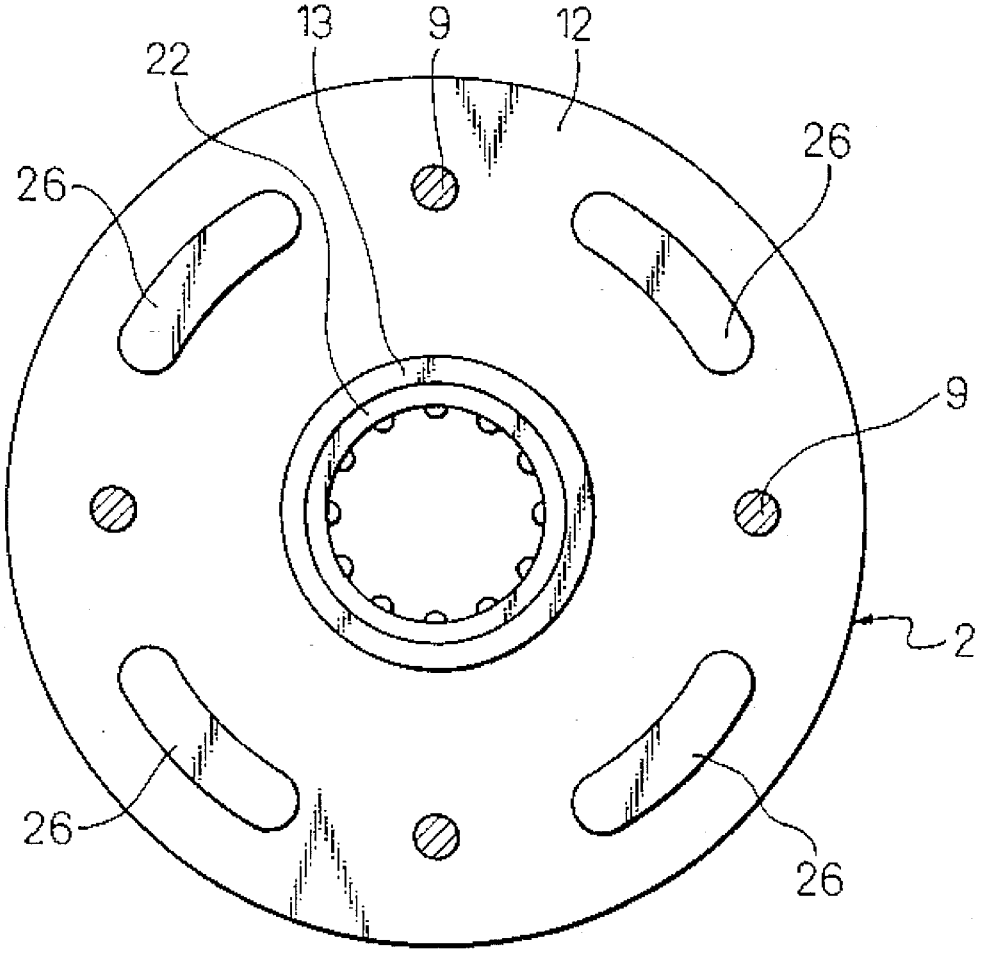

FIG. 10 is an end view of the movable scroll member in FIG. 8.

Figure 11:
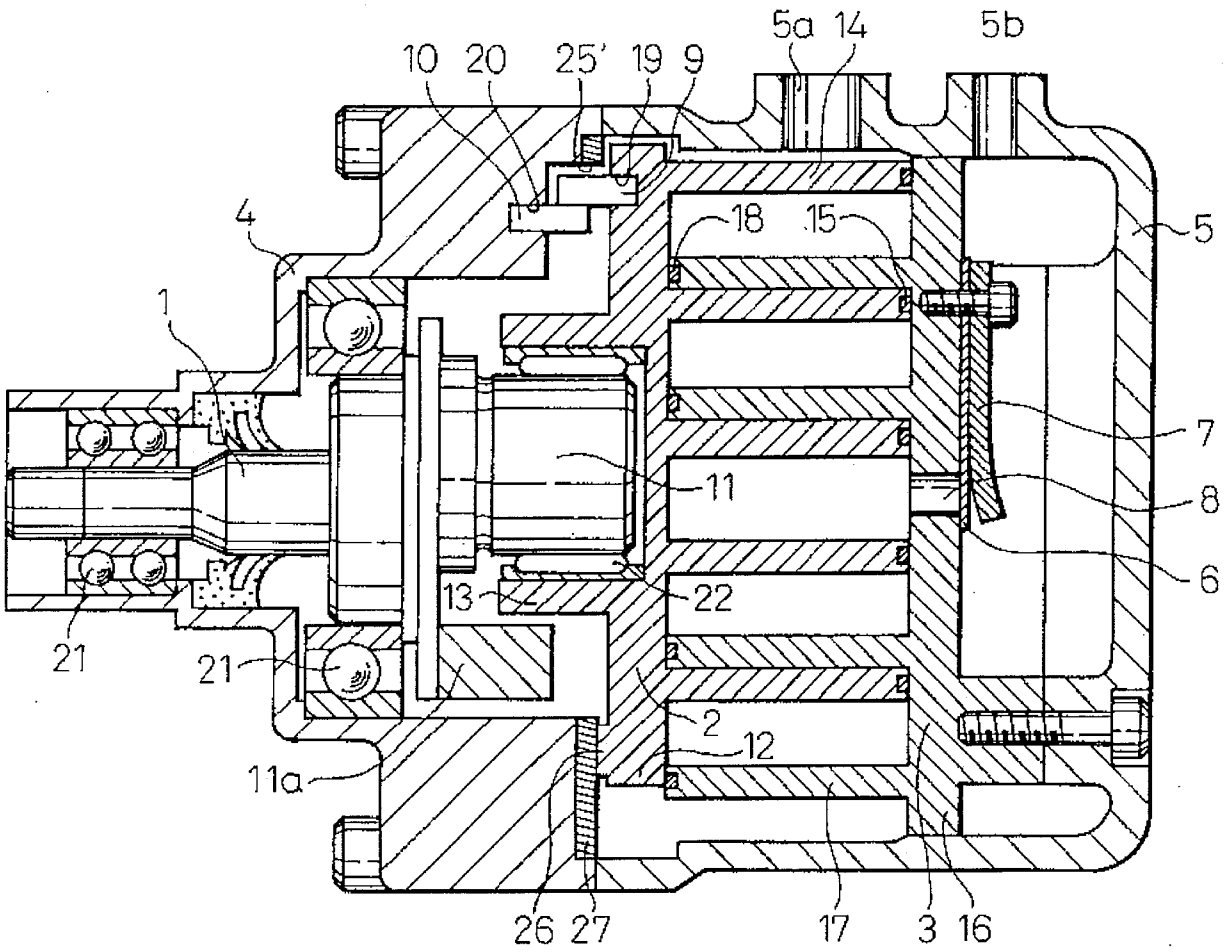

FIG. 11 is a longitudinal cross sectional view of a scroll compressor in a fifth embodiment.

Figure 12:
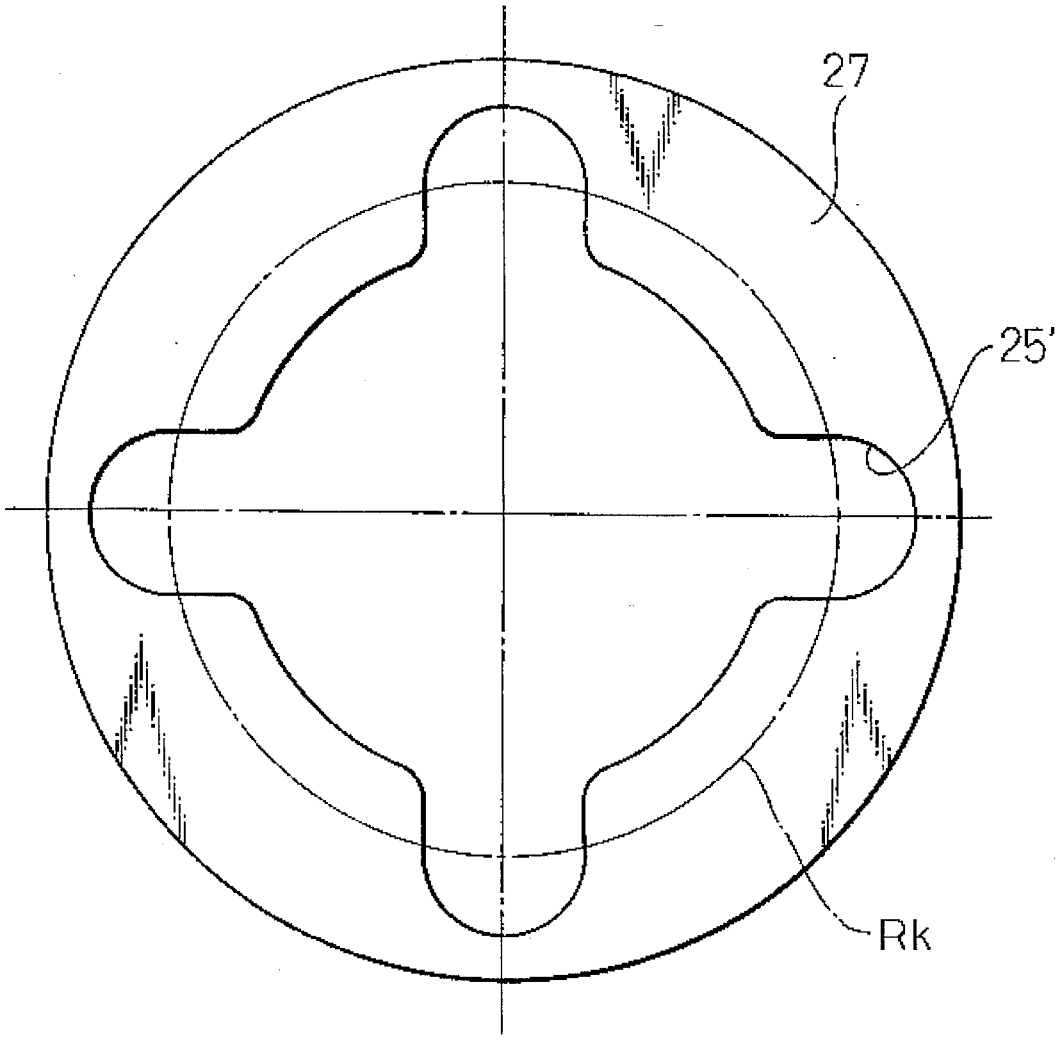

FIG. 12 is an end view of a ring plate in FIG. 11.

Figure 13:
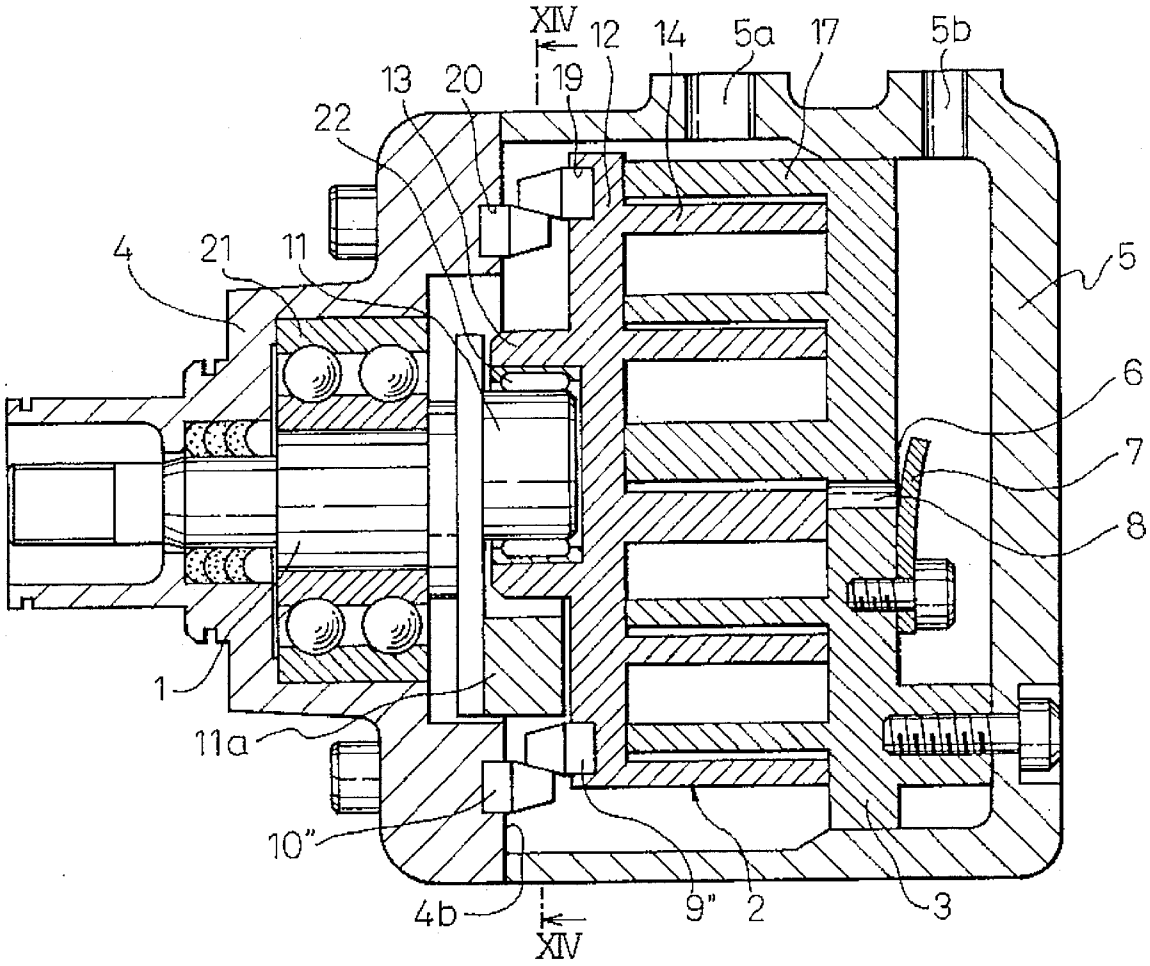

FIG. 13 is a longitudinal cross sectional view of a scroll compressor in a sixth embodiment.

Figure 14:
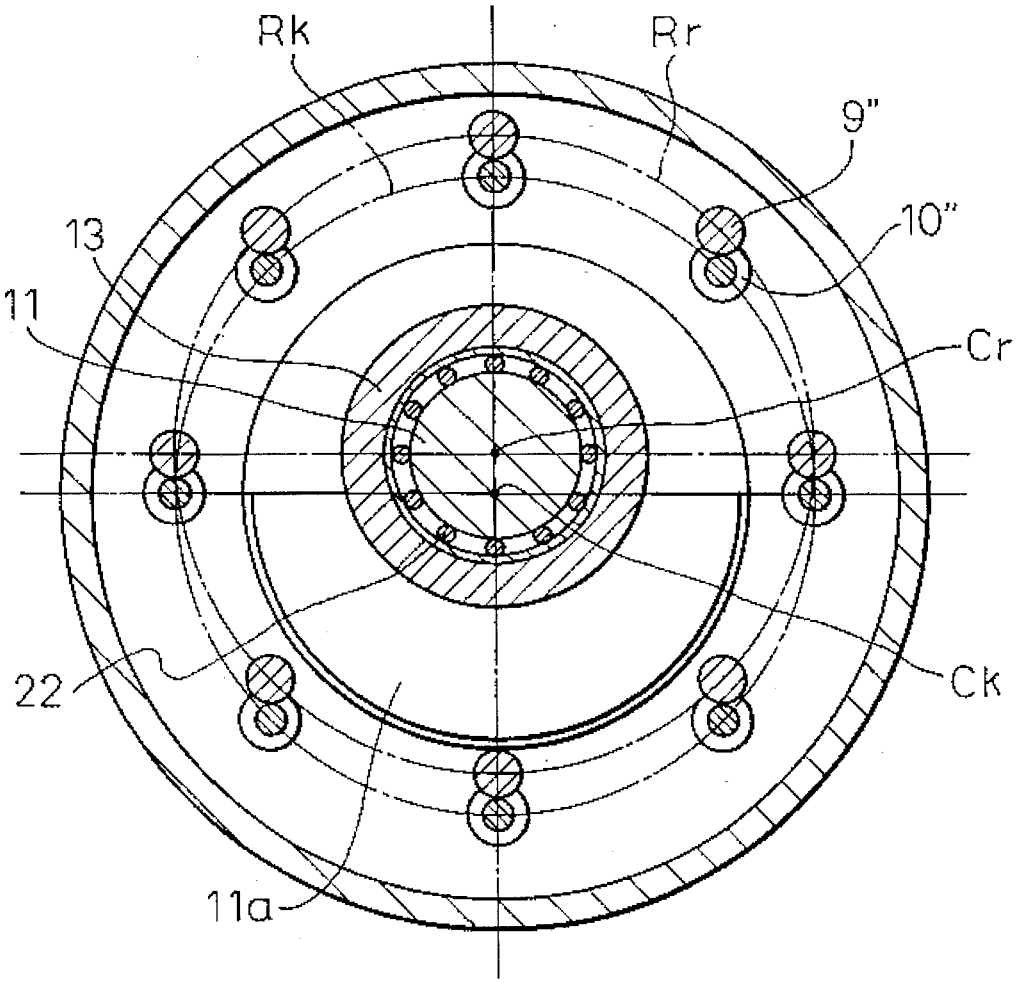

FIG. 14 is a cross sectional view taken along a line XIV—XIV in FIG. 13.

Figure 15:
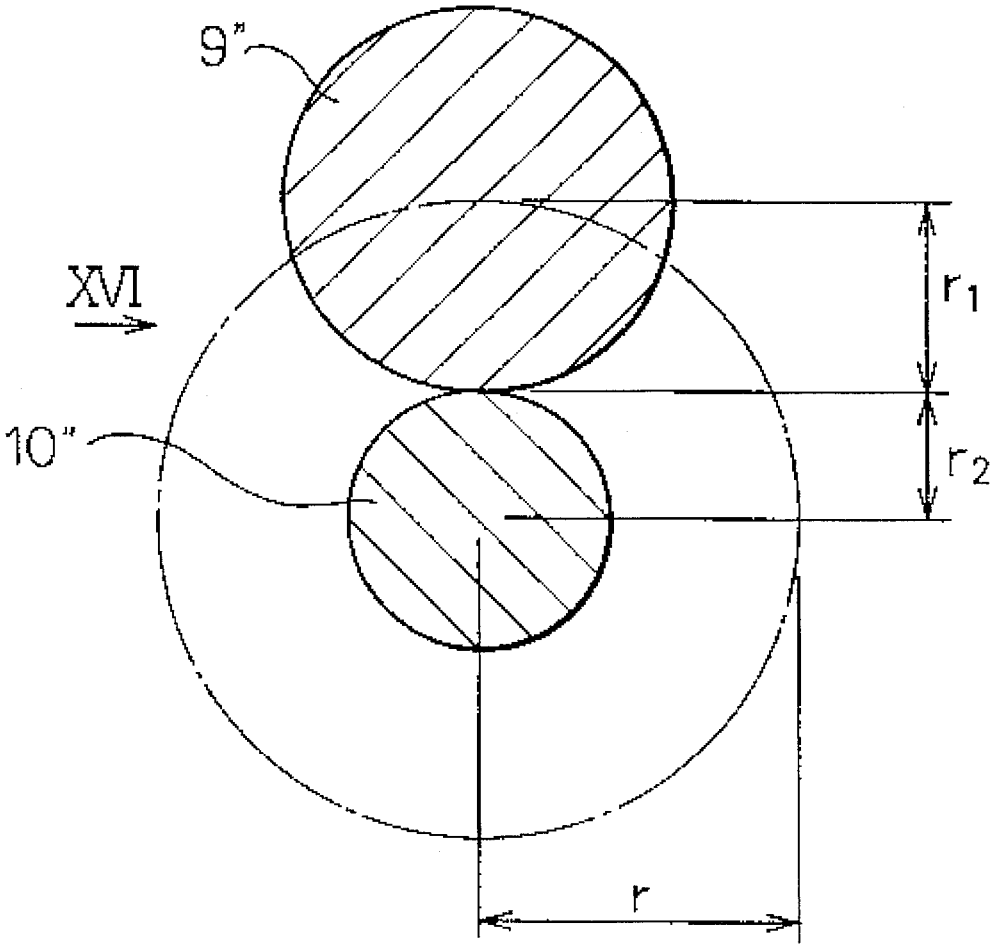

FIG. 15 is an enlarged view of a portion of FIG. 14, illustrating a relationship between diameter of pins and a radius of an orbital movement.

FIG. 16-A is a side view of the pins taken along line XVI in FIG. 15.

FIG. 16-B is similar to FIG. 16-A, but illustrates a modification of the embodiment.

Figure 17:
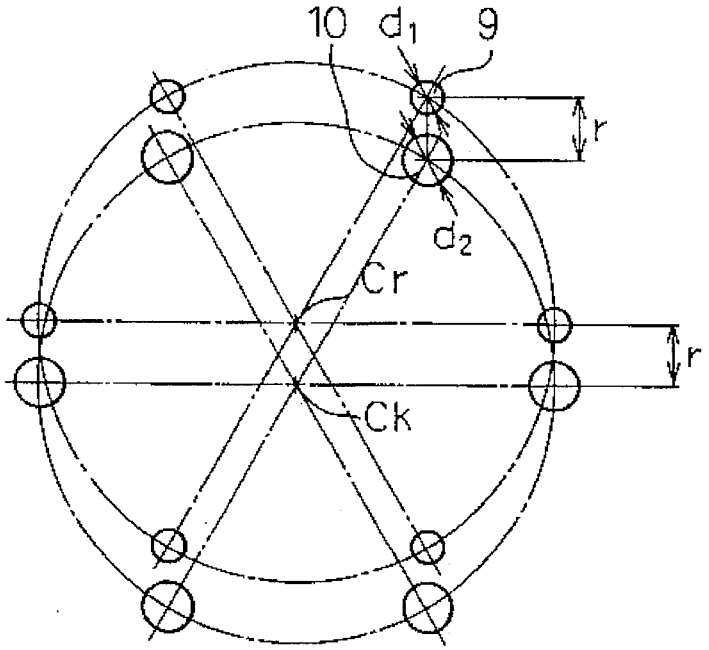

FIG. 17 shows an arrangement of pins in a seventh embodiment.

Figure 18:
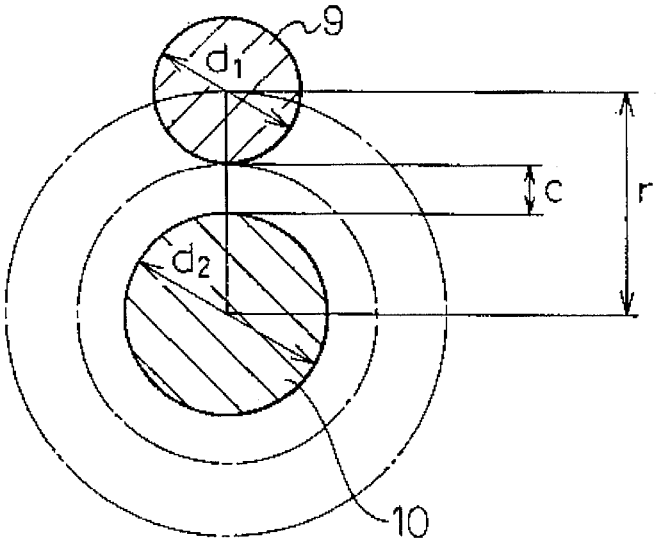

FIG. 18 is an enlarged view of a portion of FIG. 17, which illustrates a relationship between diameter of pins and a radius of an orbital movement.

FIG. 19-A is a schematic perspective view of a follower crank unit in a scroll compressor in an eighth embodiment.

FIG. 19-B is a schematic elevational view of the follower crank unit in FIG. 19-A.

Figure 20:
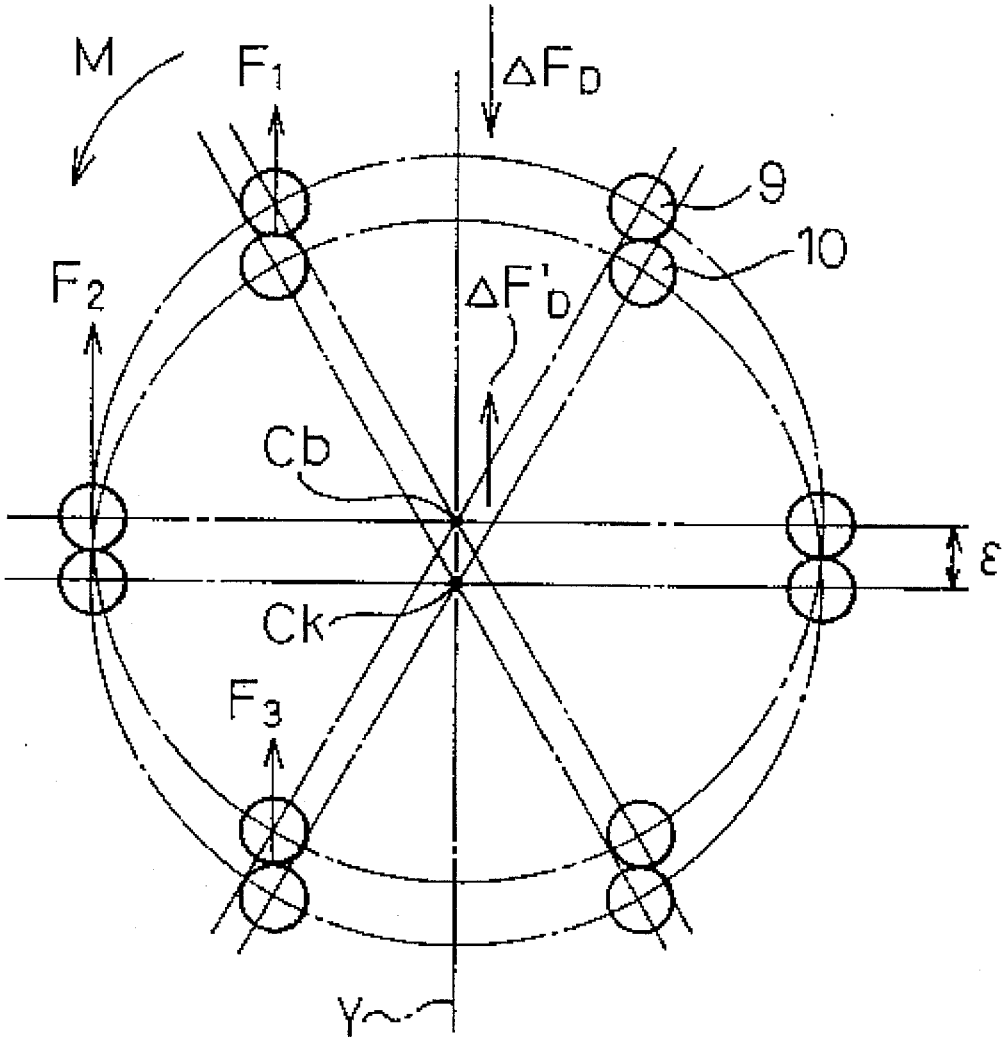

FIG. 20 is a schematic view illustrating an arrangement of pins in the eighth embodiment.

Figure 21:
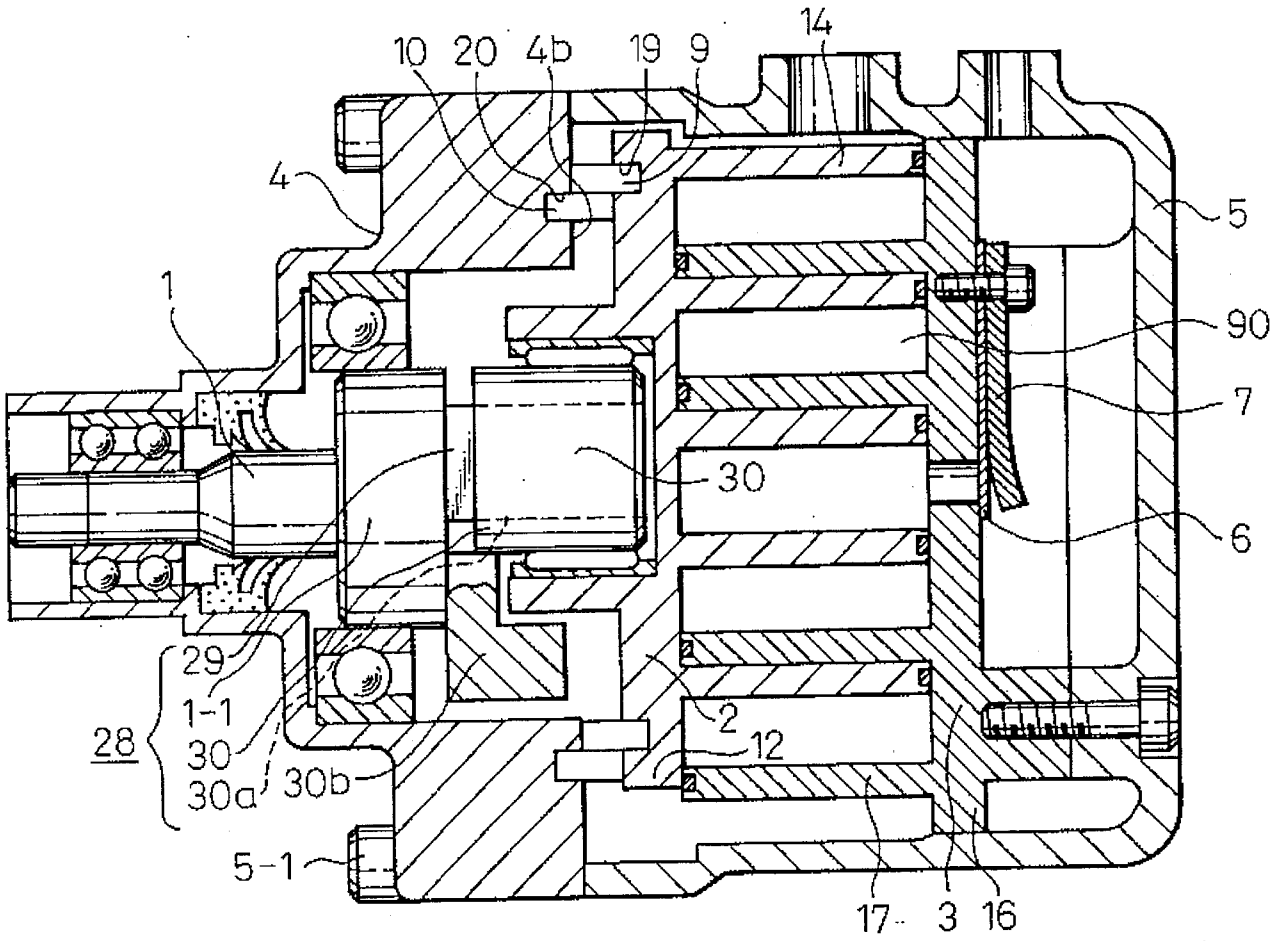

FIG. 21 is a longitudinal cross sectional view of the scroll compressor in the eighth embodiment.

Figure 22:
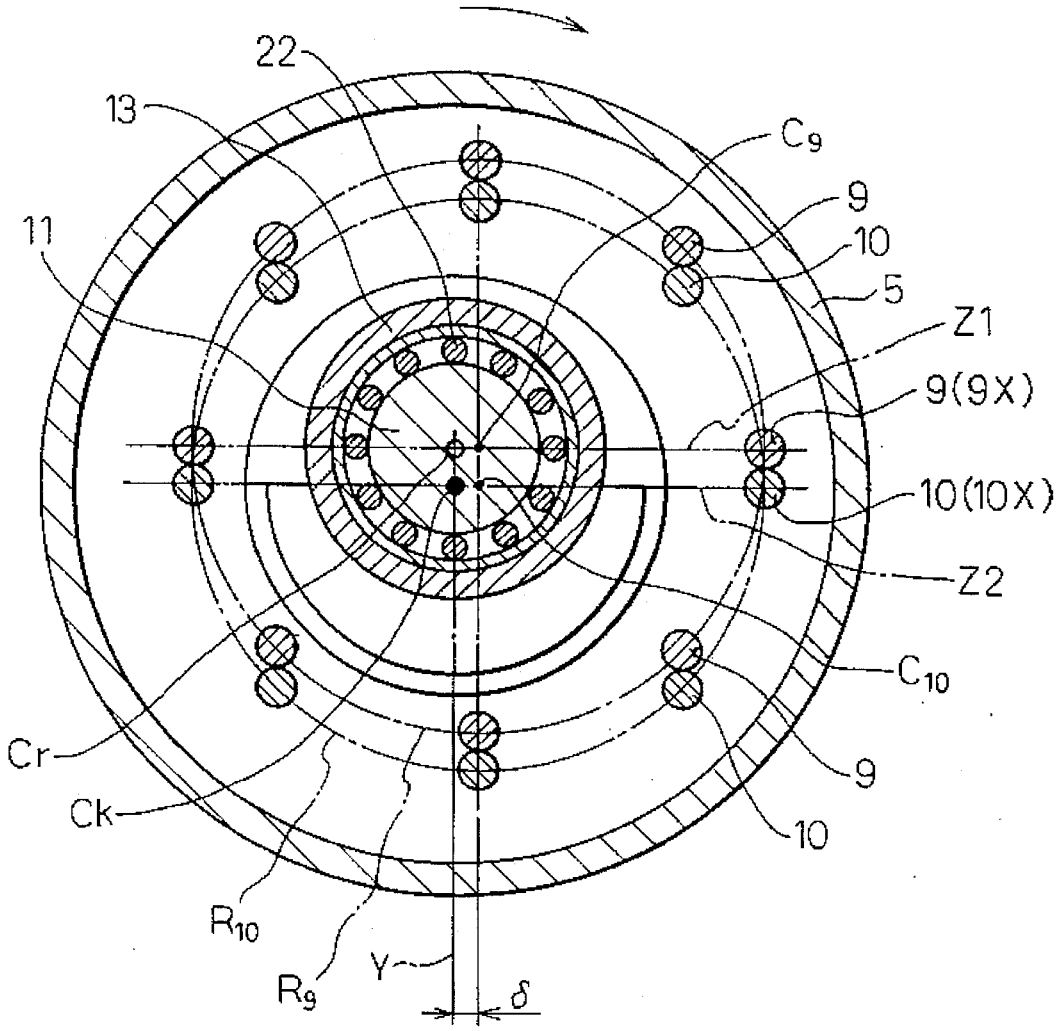

FIG. 22 is an arrangement of pins in the ninth embodiment when the movable scroll member is in a position to obtain a maximum self-rotating torque.

Figure 23:
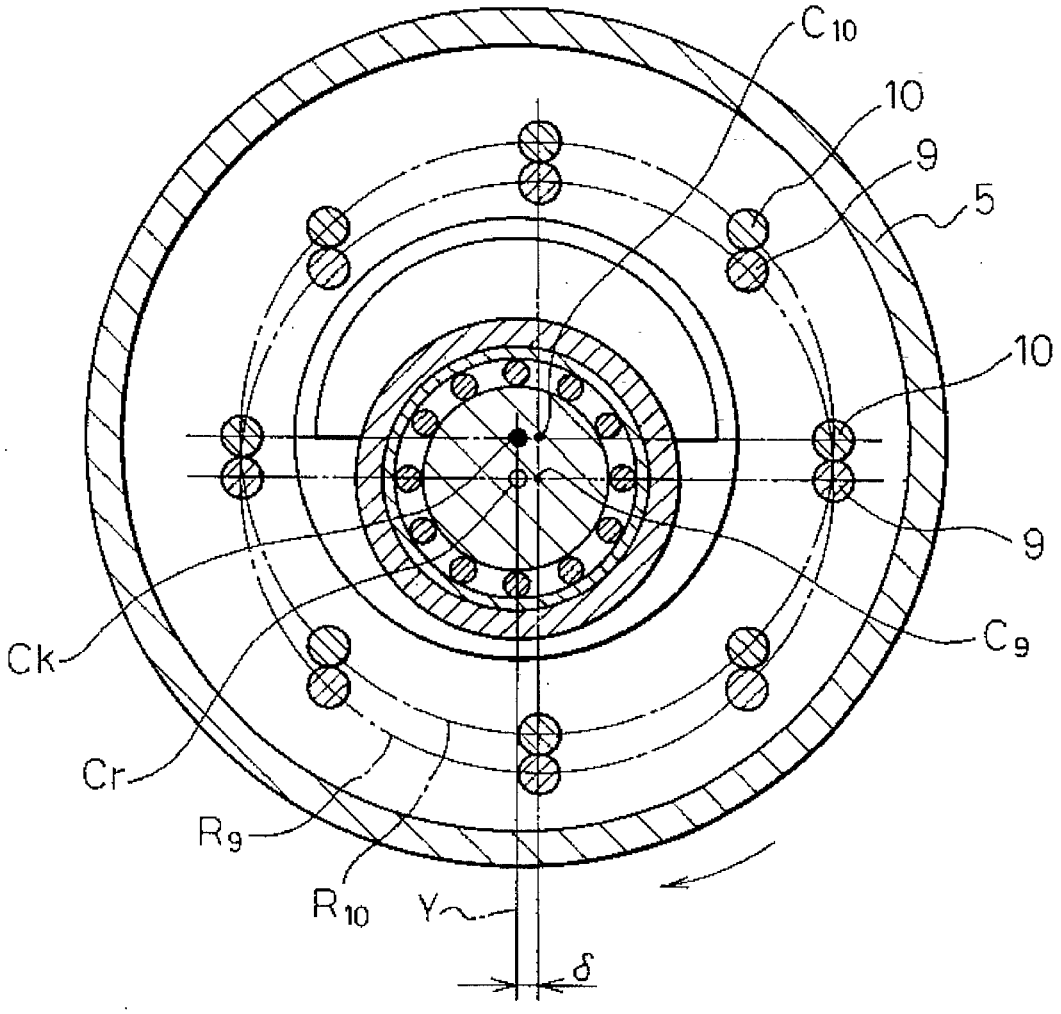

FIG. 23 is similar to FIG. 22, but illustrates an arrangement of pins in the ninth embodiment when the movable scroll member is in a position to obtain a minimum self-rotating torque.

Figure 24:
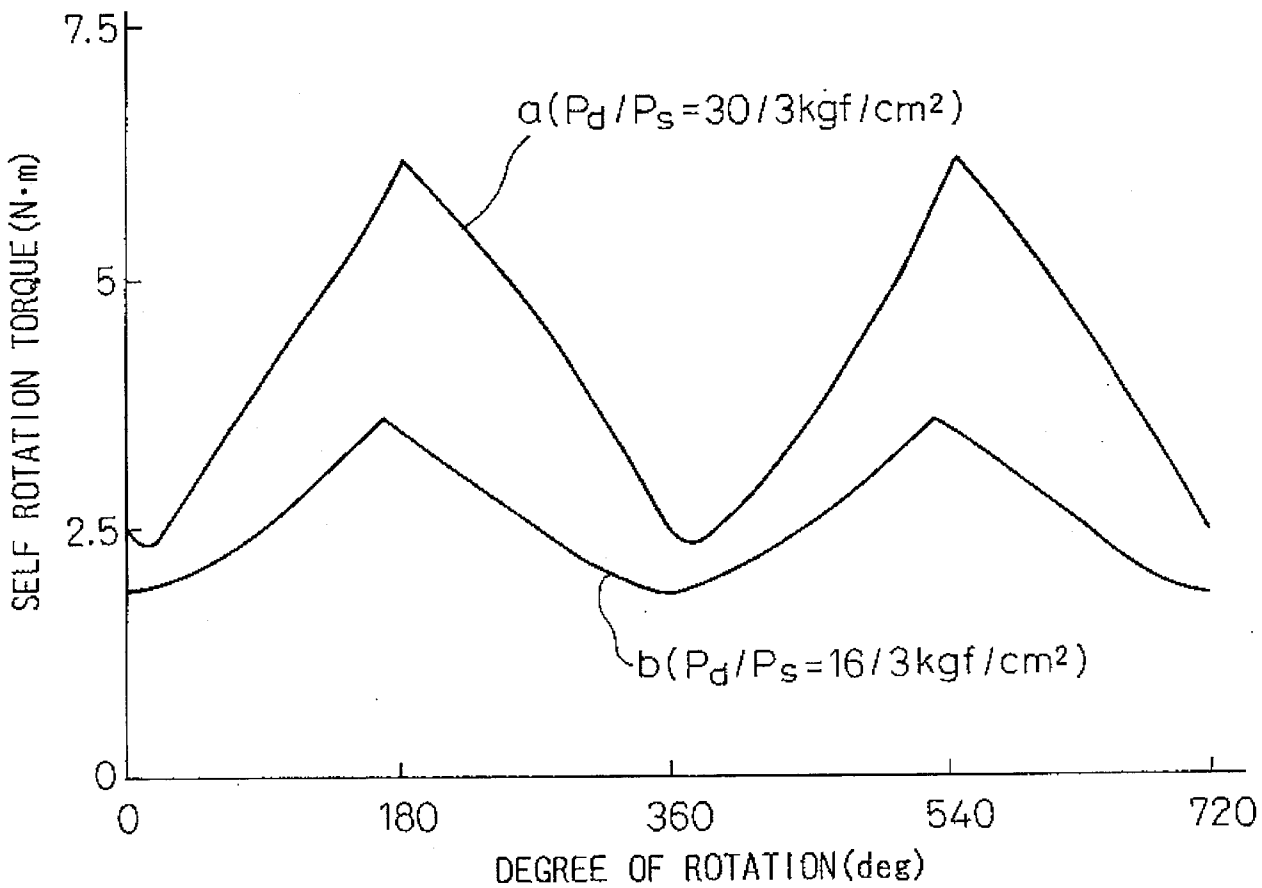

FIG. 24 is a graph showing the relationship between the angular position of the movable scroll member and a self rotating torque.

Figure 25:
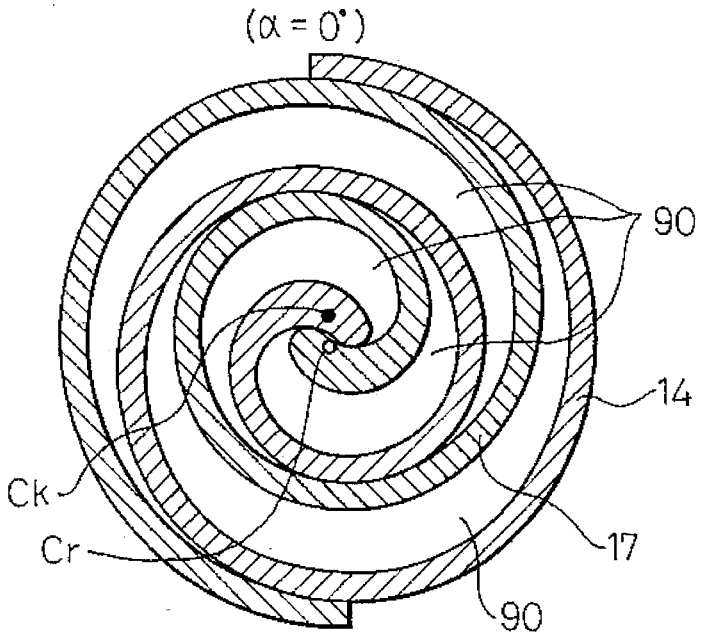

FIG. 25 shows the relationship between the movable scroll member and the fixed scroll member when self rotating torque is the minimum.

Figure 26:
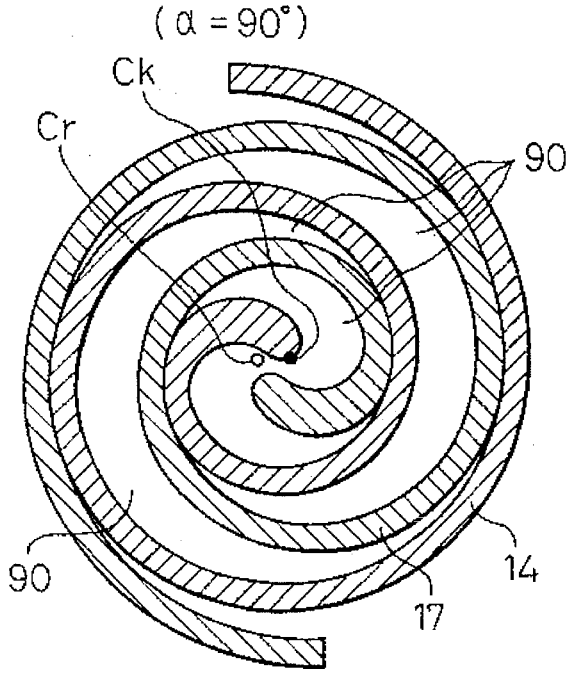

FIG. 26 shows the relationship between the movable scroll member and the fixed scroll member when self-rotating torque is increasing.

Figure 27:
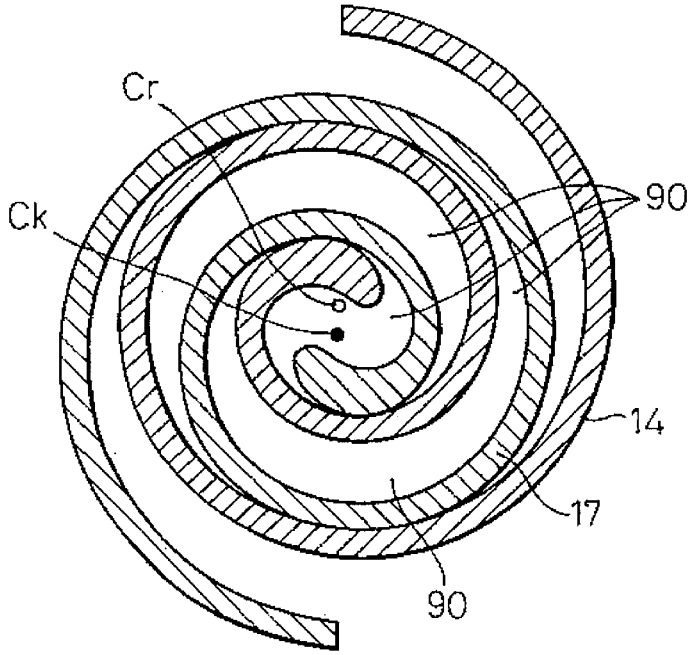

FIG. 27 shows the relationship between the movable scroll member and the fixed scroll member when self rotating torque is the maximum.

Figure 28:
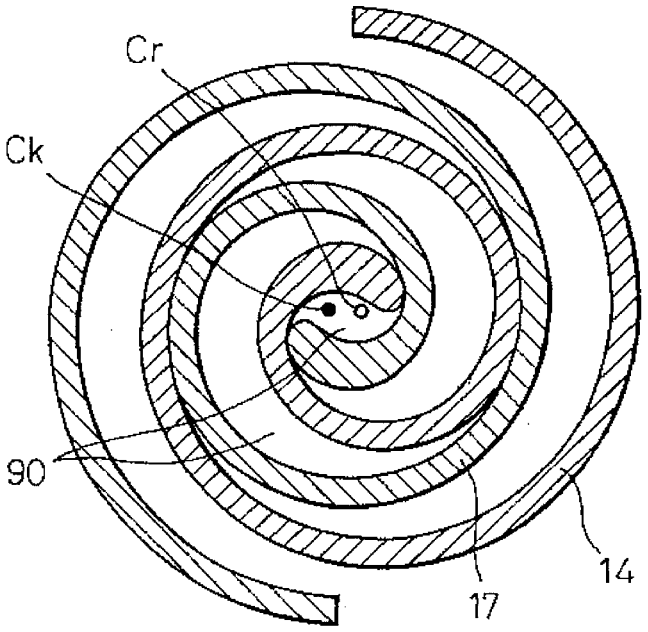

FIG. 28 shows the relationship between the movable scroll member and the fixed scroll member when self rotating torque is decreasing.

Figure 29:
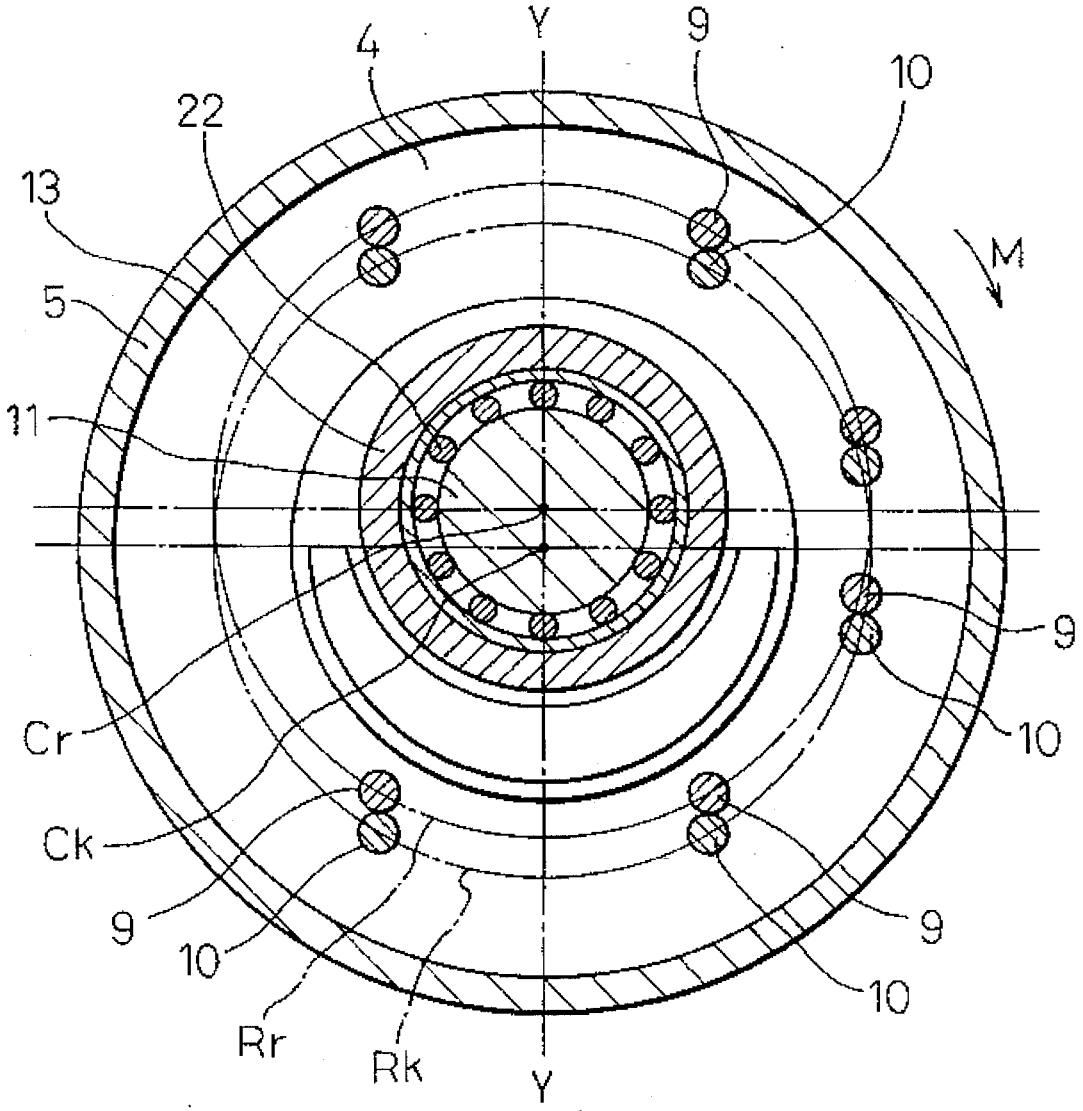

FIG. 29 is an arrangement of pins in the tenth embodiment when the movable scroll member is in a position to obtain a maximum self-rotating torque.

Figure 30:
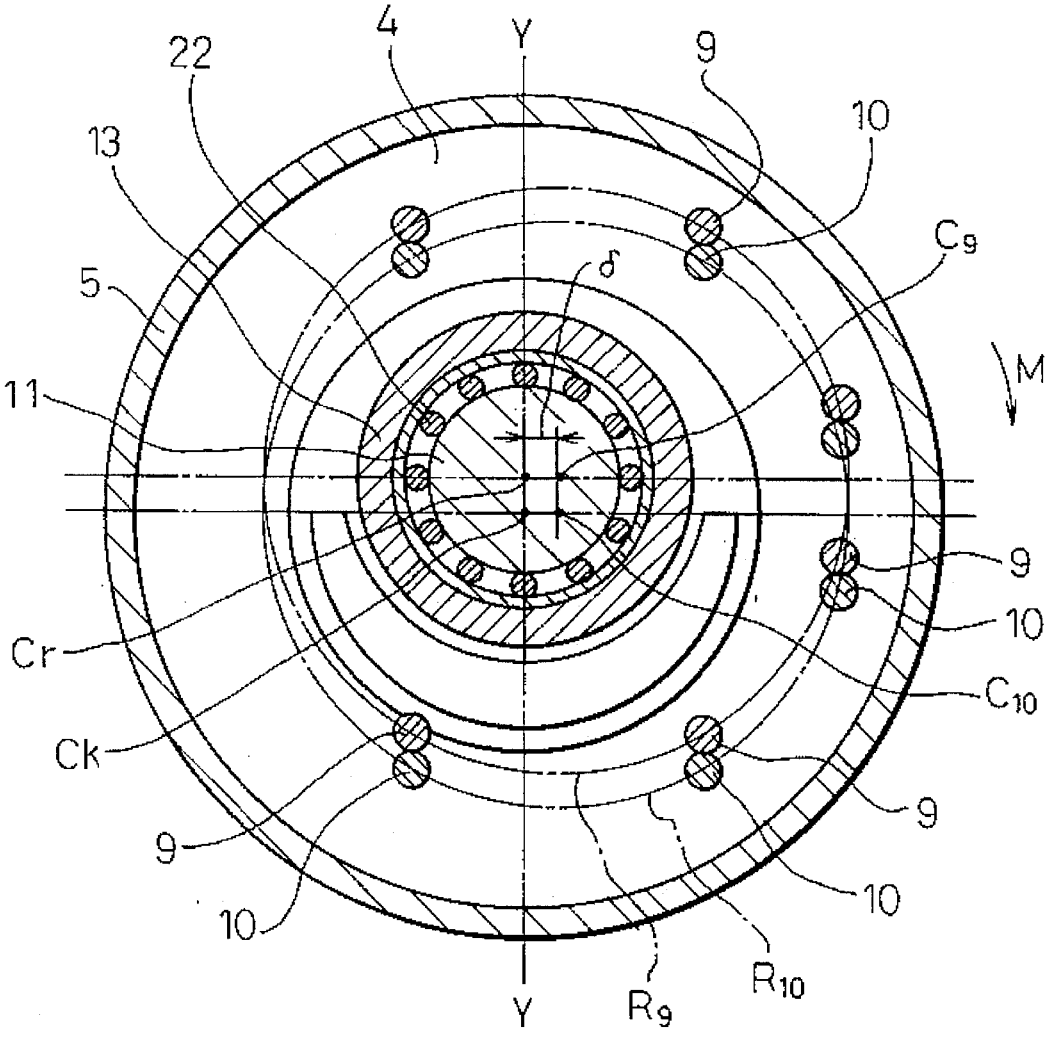

FIG. 30 is an arrangement of pins in the tenth embodiment when the movable scroll member is in a position to obtain a maximum self-rotating torque.

DESCRIPTION OF PREFERRED EMBODIMENTS

FIG. 1 shows a first embodiment of a scroll compressor, according to the present invention, which is used as a refrigerant compressor for an air conditioning system for an automobile. A reference numeral 4 denotes a front housing having a tubular boss portion 4*a* and an inner end surface 4*b*. A rear housing 5 has an open end contacting with the inner end surface 4*b*, and is fixedly connected to the front housing 4 by means of bolts 4-1. These housings 4 and 5 are made from an aluminum alloy material. A reference numeral 1 denotes a rotating shaft made of steel material, and is rotatably supported on the boss portion 4*a* of the front casing 4 by means of a radial bearing unit 21. The rotating shaft 1 has, at its inner end, a crank portion 11 having an axis which is spaced from an axis of the rotation of the shaft 1. At a location diametrically opposite the crank portion 11, the shaft 1 is provided, integrally, with a balancing weight 11*a*, which functions to cancel the centrifugal force generated at the crank portion 11 when the shaft 1 is rotated. A rotating scroll member 2 is made from an aluminum alloy which is subjected to hardening by an alumite treatment. The rotating scroll member 2 is constructed of an end disk portion 12 and a scroll portion 14 on one side of the disk portion 12 which is formed as an involute curve (FIG. 5) and which extends axially and integrally from an end surface of the disk portion 12, and a tubular boss portion 13 on the other side of the disk portion 12 away from the scroll portion 14. The crank portion 11 of the shaft 1 is inserted to the tubular boss portion 13 via a needle bearing assembly 22, so that the rotating scroll member 2 is rotatable with respect to the crank portion 11.

Reference numeral 3 denotes a fixed scroll member made also of an aluminum alloy material which is subjected to an alumite treatment. The fixed scroll member 3 is constructed of an end disk plate 16 and a scroll portion 17 on one side of the disk portion 16 which is formed as a involute curve and which extends axially, integrally from an end surface of the disk portion 16. The scroll portions 14 and 17 of the movable and fixed scroll members 2 and 3 are, as clearly shown in FIG. 5, in a side-by-side contact relationship, so that radially-spaced closed pump chambers 90 are created between the scroll members. During the rotation of the shaft, the pump chambers 90 move radially from a radially outward position with an increased volume to a radially inward position with a reduced volume. The pump chamber 90 is, at the radially outward position, opened to an intake port to allow the refrigerant to be introduced into the chamber. The pump chamber 90 is, at the radially inward position, opened outwardly to allow the refrigerant to be discharged from the chamber 90. The scroll portion 14 of the movable scroll member 2 is, at its end spaced from the base plate 12, formed with a groove in which a tip seal member 15 is arranged. The tip seal member 15 is in sliding contact with the base plate 16 of the fixed scroll member 3. The scroll portion 17 of the fixed scroll member 3 is, at its end spaced from the base plate 16, formed with a groove in which a tip seal member 18 is arranged. The tip seal member 18 is in sliding contact with the base plate 12 of the movable scroll member 3. As a result, a sealed contact is obtained between the movable and fixed scroll members 2 and 3, thereby preventing the refrigerant from leaking during the compression operation.

As shown in FIG. 1, the fixed scroll member 3 has boss portions 3-1 which contact with respective boss portions 5-1 of the rear casing 5, and bolts 100 are inserted from the rear casing 5 and screwed, via the boss portions 5-1, to the boss portions 3-1, so that the fixed scroll member 3 is fixed to the casing. An outlet chamber 102 is formed between the base plate 16 of the fixed scroll member 3 and the rear casing 5, while an inlet chamber 104 is formed between the front casing 4, the rear casing 5 and the movable scroll member 2. The inlet port **5*a* on the casing 5 is opened to the inlet chamber 104 for introducing the refrigerant into the chamber 104. The outlet port 5*b* on the casing 5 is opened to the outlet chamber 102 for discharging the compressed refrigerant gas. Furthermore, the base plate 16 of the fixed scroll member 3 is formed with an outlet port 8 which is opened to a pump chamber 90, when the chamber 90 is at the inner most position. A delivery valve 6 together with a support member 7 are, at their ends, fixed to the base plate 16 of the fixed scroll member 3 by means of a bolt 106. The delivery valve 6 is formed as a reed valve providing a resilient force, which urges the valve 6 to rest on the base plate 16 to normally close off the outlet port 8. Compression of the refrigerant gas causes the delivery valve 6 to be displaced until it rests against the support member 7. As a result, the outlet port 8 is opened, and the refrigerant gas from the pump chamber 90 is discharged into the outlet chamber 102**.

Figure 2:
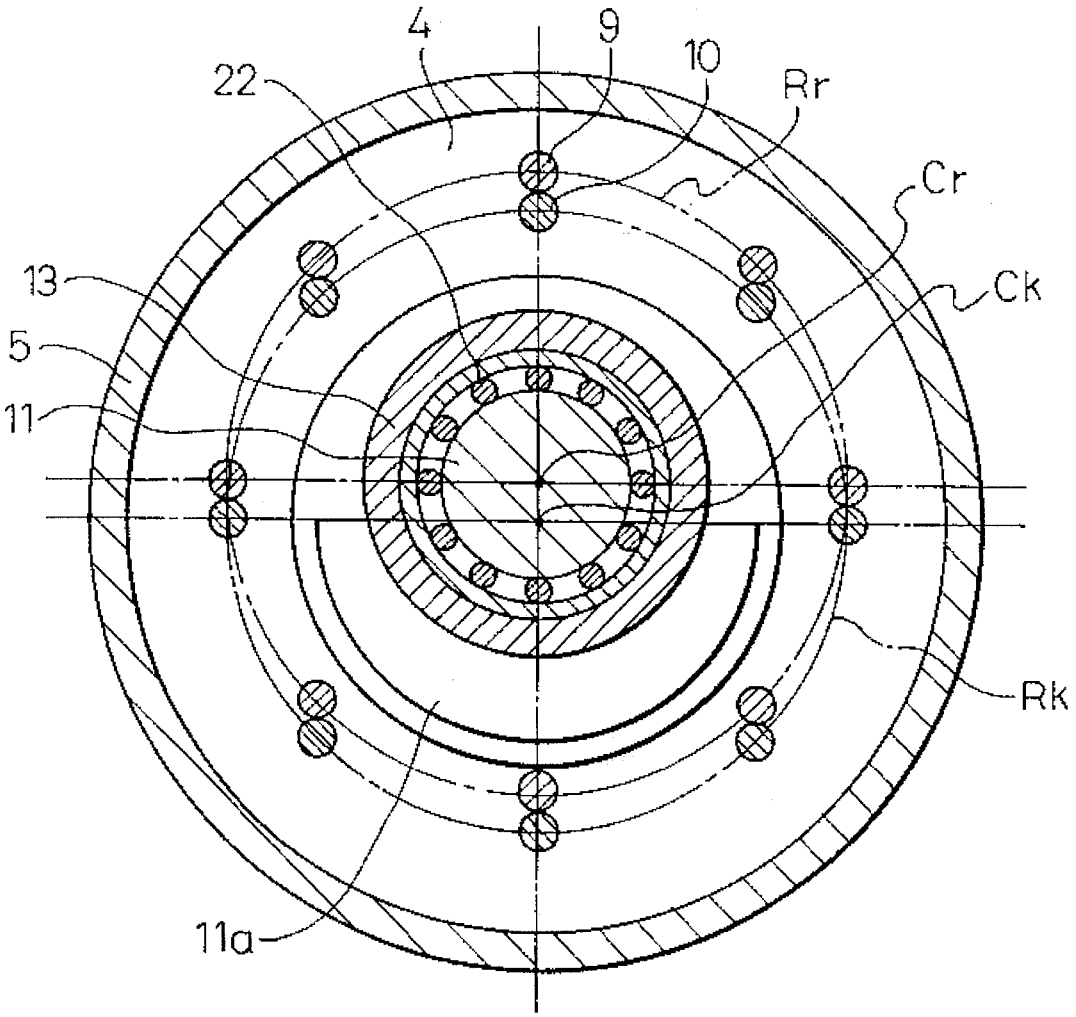
FIG. 2 is a cross-sectional view taken along a line II—II in FIG. 1.

The end plate 12 of the movable scroll member 2 contains a plurality of equiangularly-spaced circular holes 19 along a circle Rr about an axis Cr of the boss portion 13, as shown in FIG. 2. Similarly, the front casing 4 contains, at the end facing the movable scroll member 2, a plurality af equiangularly spaced circular holes 20 along a circle Rk about an axis Ck of the rotating shaft 1, the radius of circle Rk being the same as that of the circle Rr. The circles Rr and Rk will now be referred as pitch circles. As shown in FIGS. 1 and 2, paired pins 9 and 10 are fixed in the holes 19 and 20, respectively by any suitable means such as a press fitting, so that pins 9 and 10 extend axially out of the face-end surfaces of the movable scroll member 2 and the front housing 4 for the fixed, same distance, as shown in FIG. 1. This distance is such that the end of the pins 9 and 10 contact the faced-end surface of the front housing 4 and the movable scroll member 2, respectively. These pins 9 and 10 may be made from a material, such as a steel, which is different from the material for constructing the movable scroll member 2 and the front casing 4.

In the first embodiment, as described above, a self-rotation blocking mechanism is constructed of eight pairs of the pins 9 and 10 of the same diameter d, which is equal to the eccentricity of the crank member 11 with respect to the drive shaft 1, i.e., the radius r of the orbital movement of the crank member 11, i.e., the radius of the orbital movement of the movable scroll member 2 journaled on the crank portion 11, as shown in FIG. 3. FIG. 2 shows the relative arrangement of the pins 9 and 10. Since the pins 9 and 10 are fitted to the holes 19 and 20, respectively, the pins 9 are equiangularly spaced on the pitch circle Rr about the center Cr of the boss portion 13 of the movable scroll member 2 (center of the crank portion 11), while the pins 10 are equiangularly spaced on the pitch circle Rk about the center Ck of the drive shaft 1 supported by the front casing 4. Furthermore, the arrangement of the pins 9 on the movable scroll member 2 and the pins 10 on the front housing 4 is such that the pins 9 and 10, which are located adjacent with each other and construct pairs, are in a side-by-side contacted condition. However, between the pairs, the same relative position between the pins 9 and 10 is maintained, due to the fact that the angularly spaced relationship of the pins 9 on the pitch circle Rr on the rotating scroll member 2 is the same as the angularly spaced relationship of the pins 10 on the pitch circle Rk on the front housing 4. However, according to the present invention, it should be noted that the equiangularly spaced relationships of the pins 9 and 10 on the pitch circles Rr and Rk are not essential. Namely, spacing between the adjacent pins 9 and 10 on the pitch circles Rr and Rk need not be the same. However, the relative position between pairs of the pins 9 and 10 must be unchanged.

It should be appreciated that friction caused by sliding movements occur at contact areas such as areas between the pins 9 and 10, and between pins 9 and 10 and the end surfaces of the movable scroll member 2 and the front casing 4. Thus, advantageously, a suitable means for reducing the frictional force, such as a means for supplying lubricant to the above contact areas should be provided.

Now, the operation of the scroll compressor according to the present invention will explained. When the drive shaft 1 rotates, the crank portion 11 at the end of the shaft 1 rotates the movable scroll member 2 at its boss portion 13 via the needle bearing unit 22. As a result, the pins 9 on the end plate 12 of the movable scroll member 2 executes an orbital movement about the pins 10 on the front casing 4 along an orbit $R_9$ shown in FIG. 3. During the orbital movement, the pins 9 and 10 maintain their mutual side-by-side contact condition due to the fact that the diameter d of the pins 9 and 10 is equal to the distance between the axis of the rotating shaft 1 and the axis of the crank portion 11 (the axis of the boss portion 13 of the movable scroll member 2), which is equal to the eccentricity of the crank portion 11 from the shaft 1, i.e., the radius r of the orbital movement of the crank portion 11 (the orbital movement of the movable scroll member 2).

Now, the mechanism for preventing the movable scroll member 2 from being rotated about its own axis will be explained with respect to FIGS. 4-A and 4-B, and 5. Namely the pins 9 on the movable scroll member 2 are subjected to the orbital movement about the respective fixed pins 10 on the front casing 2. In FIGS. 4-A and 4-B, the line Y connects the centers Cr and Ck, and diametrically opposite pairs of the pins 9 and 10 are located on this line, according to this embodiment. However, a different arrangement can be employed. With regard to a torque, as shown by an arrow M in FIG. 4-A, generated to urge the scroll member 2 to be rotated in the clockwise direction about its own axis, the pins 9*a*, 9*b* and 9*c* on the movable scroll member 2 are pressed to the paired stationary pins 10*a*, 10*b* and 10*c*, respectively on the right-hand side of the front casing 4, thereby preventing the movable scroll member 2 from being rotated about its own axis. In this case, vertical, upward forces F', F and F" are generated at the centers of the pins 9*a*, 9*b* and 9*c*, respectively, due to respective reaction forces generated at contact points between the pins 9*a* and 10*a*, the pins 9*b* and 10*b*, and the pins 9*c* and 10*c*, respectively. In FIG. 4-A, the force F acting on the pin 9*b* functions, as a whole, as the self-rotation blocking force, due to the fact that the vertical direction of the force corresponds to the direction of the self-rotation of the movable scroll member 2. Contrary to this, as to the forces F' and F" generating in the pins 10*a* and 10*c*, respectively, not all of these forces function to prevent the self rotation of the movable scroll member 2, due to the fact that the directions of these forces F' and F" do not correspond to the direction of the self-rotation of the movable scroll member 2. Namely, among the forces F' and F", components f' and f", in the direction of the self-rotation, function to prevent the self rotation of the movable scroll member 2. In FIG. 4-A, the pins 9*e*, 9*f* and 9*g* located on the left-hand side, as well as the pins 9*d* and 9*h* located on the vertical diametrical line Y do not function to prevent the self rotation of the movable scroll member 2, due to the fact that a force to prevent the self rotation is not generated in the pins 9*d*, 9*e*, 9*f*, 9*g* and 9*h* in contact with the pins 10*d*, 10*e*, 10*f*, 10*g* and 10*h*. In other words, the function for preventing the self rotation is obtained at the pins which generate the upward force like F, F' and F". Contrary to this, other pins, like pins 9*d*, 9*e*, 9*f*, 9*g* and 9*h* in FIG. 4-A, which do not generate the upward force, cannot function to prevent self-rotation. In short, in order to obtain the self-rotation blocking function of the movable scroll member 2 in the clockwise direction in FIG. 4-A, it is essential that the movable pins such as pins 9*a*, 9*b* and 9*c* contract the fixed pins such as pins 10*a*, 10*b* and 10*c*, respectively.

With regard to a torque, as shown by an arrow M in FIG. 4-B generated to urge the scroll member 2 to be rotated in the counterclockwise direction about its own axis, the pins 9*g*, 9*f* and 9*e* on the movable scroll member 2 are pressed against the stationary pins 10*g*, 10*f* and 10*e*, respectively on the left-hand side of the front casing 4, thereby generating vertical, upward forces F', F and F" and providing component forces f', f and f" in the direction opposite to the direction of the self rotation, thereby preventing the movable scroll member 2 from being rotated about its own axis.

In view of the above, in the scroll compressor according to the present invention, a plurality of contacting pairs of the pins 9 and 10 are provided such that, among the pairs, at every angular position of the movable scroll member, at least one pair is located in such a manner that a force opposite to the direction of the self rotation of the movable scroll members is generated. As a result, according to the present invention, during the orbital movement of the rotary scroll member 2 while in contact with the fixed scroll member 3, the movable scroll member 2 is prevented from being rotated about the boss portion 13. Thus, a radially inward displacement of the points of the contact between the scroll portion 14 of the movable scroll member 2 and the scroll portion 17 of the fixed scroll member 3 is obtained, which causes the closed pump chambers 90 (FIG. 5) to be moved radially inwardly, while the volume of the pump chambers 90 is successively reduced, in order to obtain compression of the refrigerant. During the compression operation, an axial thrust force in the movable scroll member 2 generated by a compression reaction force is received by the casing 4, via the pins 9 and 10, which are in end-to-end contact with the faced surfaces of the casing 4 and the scroll member 2. As a result, an axial supporting of the movable scroll member 2 is attained, thereby preventing the latter 2 from being axially displaced.

In the above first embodiment of the present invention, the self-rotation blocking mechanism is constructed merely by a combination of the pins 9 and 10 of the same diameter. No other parts are required, thereby reducing the number of parts and simplifying the construction of the pump. Furthermore, the pins 9 and 10 can be located on the outermost area of the movable scroll member 2 and the front housing 4, which is effective for reducing the outer diameter of the compressor.

FIG. 6 is an arrangement of pins constructing a self-rotation blocking mechanism in the second embodiment. Namely, in the first embodiment, as already illustrated with reference to FIG. 3, the pins 9 and 10 on the movable scroll member 2 and the front casing 4, respectively for constructing the self rotation blocking mechanism are of the same diameter d, which is equal to the radius r of the orbital movement. Unlike the first embodiment, in this second embodiment, as shown in FIG. 6, pins 9' connected to the movable scroll member and pins 10' connected to the casing have the different diameter $d_1$ and $d_2$, respectively. Furthermore, half of the sum of the diameters of the pins 9' and 10' is equal to the radius r of the orbital movement. Namely, the radius is expressed by the following equation:

$$r = \frac{d_1 + d_2}{2}$$

In this embodiment, as in the first embodiment shown in FIG. 3, the orbital movement of the movable scroll member 2 causes the pins 9' on the end plate 12 of the movable scroll member 2 to be subjected to an orbital movement of a radius r about the axis of the corresponding pins 10' fixed to the front casing 4, while the movable pins 9' are maintained in contact with the corresponding fixed pins 10'. Self-rotation of the movable scroll member 2 about its own axis is thus prevented due to the fact that at least one pair of the contacting pins 9' and 10' produces a force for opposing the rotation of the movable scroll member about its own axis.

Now, a third embodiment of the present invention will be explained. As explained above, in the first and second embodiments, the pins 9 and 10, which are in face to face contact with each other, are fixed to the corresponding circular recess 19 and 20 of the end plate 12 and the end surface of the front casing 4, respectively by a suitable means, such as a press fitting. In this case, a large frictional force is generated at the contact area between the pins 9 and 10 which are in face-to-face sliding contact. Thus, in order to prevent these parts from wearing, a lubrication system is necessary. In view of this, the third embodiment of the present invention is directed to the reduction of friction between the pins 9 and 10 by making them roll against each other, thereby increasing the reliability of the compressor. Namely, the third embodiment is, in its construction and operation, the same as those in the first and second embodiments shown in FIGS. 1 to 6, except that the pin members 9 and 10, constructing respective pairs, are, instead of being press fitted as is the case in the first and second embodiments, loosely fitted to the corresponding circular recess 19 and 20 in the end plate 12 of the movable scroll member 2 and the end surface of the front casing 4, respectively, so that pins 9 and 10 are freely rotatable in the recess 19 and 20, respectively. As a result, a rolling contact state is obtained between a contacted pair of the pins 9 and 10 along their contact line, thereby reducing the frictional force. Furthermore, even in a situation that a sliding conlact occurs between the contacting pairs of pins 9 and 10, the resultant contacting pressure therebetween is small, thereby preventing the parts from being quickly worn out. Furthermore, this construction is advantageous in that the replacement of the pins is very easy when an adjustment of the gaps between the pins 9 and 10 or a replacement of the pins is necessary.

FIG. 7 shows the third embodiment. Namely, ring members 23 and 24, made of a low friction material (bearing material) such as a white metal are fitted to circular recess 19' and 20' of the end plate 12 of the movable scroll member 2 and the end wall of the front casing 4, respectively, and the pins 9 and 10 are rotatably inserted to the ring members 23 and 24, respectively, in order to reduce the frictional force caused by the sliding movement of the pins 9 and 10. As an alternative, a press fit condition of the pins 9 and 10 is obtained as in the first embodiment, while, ring members made of a hardened metal material are freely rotatably placed on the press fitted pins 9 and 10, so that the ring members on the pins 9 and 10 are in a rolling contact condition, thereby further reducing friction caused by the direct contact. It should be noted that this means for reducing friction can be provided only for the pins 9 or for the pins 10.

In the first embodiment, the axial load (thrust) as a compression reaction force acting on the movable scroll member 2 is supported by the ends of the pins 9 and 10 of the self-rotation blockage mechanism, which contact with the end wall **4*b* of the front casing 4 and the end plate 2 of the movable scroll member 2, respectively. As a result, the value of the contact pressure at these contact areas is determined by the number and diameter of these pins 9 and 10. Thus, in order to reduce the contact pressure, an increase in the number or diameter of the pins 9 and 10** is essential, which increases the outer size, as well as a manufacturing cost, of the compressor.

In view of this, in FIGS. 8 to 10, which show a fourth embodiment of the present invention, the front casing 4 has an end wall **4*b* (FIG. 8) which contains circumferentially spaced recesses 25 of a substantially circular shape, which are concentric with the respective fixed pins 10. The pins 9 on the end disk 2 of the movable scroll member 2 project to the corresponding recess 25, so that the pins 9 make a side by side contact with the corresponding pins 10, which allows the movable pins 9 to rotate about the corresponding pins 10, while preventing the movable scroll member 2 from being rotated about its own axis. However, unlike the first embodiment, the pins 9 and 10 are prevented from axially contacting with the end wall 4*b* of the front casing and the end disk 2 of the movable scroll member 2, respectively, as clearly shown in FIG. 8. In order to allow the casing to receive the axial thrust force, as shown in FIGS. 8 and 10, the end plate 2 of the movable scroll member 2 is formed with equiangularly spaced apart arc-shaped projected portions 26 on the same circumference on which the pins 9 are located. As shown in FIG. 8, the projected portions 26 are in face-to-face sliding contact with the end wall 4*b* of the casing 4, while the movable scroll member 2 rotates, to receive the axial thrust force from the movable scroll member. It is advisable that the projected portions 26 and/or the surface of the end wall 4*b* of the front casing 4 in contact with the projected portions 26** are given a hardening surface treatment.

According to the fourth embodiment, since the axial load is separately supported by the projected portions 26 on the end plate 12 which are under the sliding contact with the surface **4*b* of the casing 4, the pins 9 and 10 as the self-rotation blocking mechanism are saved from functioning to support the axial thrust force. As a result, the number, as well as the diameter, of the pins 9 and 10 can be reduced. Namely, as shown in FIG. 9, only four pairs of pins 9 and 10 are used in this embodiment. Furthermore, the possibility of damaging the pins 9 and 10 at their contact ends is reduced, thereby increasing their reliability. As will be clearly seen from FIG. 10, projected portions 26 are arranged in dead areas between circumferentially adjacent pins 9, thereby attaining an effective use of the existing available locations and preventing the size of the compressor from being increased, while forming the projections 26** with a desired area and a number for obtaining a desired axial force supporting function.

FIG. 11 and 12 show a fifth embodiment of the invention. Unlike the fourth embodiment where the projected portions 26 on the end plate 12 of the movable acroll member 2 are in direct contact with the end face **4*b* of the casing 4, with or without a surface hardening treatment, the fifth embodiment features a separate plate 27 that is attached to the front casing 4, which plate 27 is made from a low friction material such as a polished steel, which allows the movable scroll member 2 made of the aluminum alloy to slide on the plate 27. As shown in FIG. 12, the anti-friction plate 27 forms an annular shape, which has an inner periphery containing equiangularly spaced cut out portions 25' at locations corresponding the contacted pairs of the pins 9 and 10, which cut out portions 25' allow the movable pins 9 to be rotated about the corresponding fixed pins 10**.

The pins for constructing the self-rotation blocking mechanism according to the present invention (the pins 9 and 10 in previous embodiments) are formed in a cantilever fashion. In such a cantilever construction of the pins, when a load is applied, the bending moment in the cross section is zero at the free end of the pins, while attaining the maximum value at their root portions. In other words, the pins must have a cross sectional area which can resist the maximum moment at the root portion, so that the stress at the root portion is smaller than a maximum permissible level. Thus, if the pins 9 and 10 are of the straight type, i.e., the same diameter along their entire length, as is the case in the previous embodiments the cross sectional area at areas other than the root area are larger than the desired values, which makes the stress lower than the maximum permissible level. Thus, the straight type pins are defective in that material is wasted, on one hand, and the weight of the compressor is increased, on the other hand.

FIGS. 13 to 15 and FIG. 16-A show a sixth embodiment of the present invention. In FIG. 13, the scroll compressor includes circumferentially-spaced pairs of opposite, side-by-side contact pins 9" and 10". These pins 9" and 10" are press fitted to corresponding openings 19 and 20 on the end plate 12 of the movable scroll member 2 and the end wall **4*b* of the front casing 4, respectively, as in the first embodiment. Other constructions are substantially the same as those in the first embodiment and a detailed explanation thereof will be omitted. As shown in FIG. 16-A, each of the pins 9" is constructed of a base portion 9"-1 as a cylindrical column shape fitted to a corresponding recess 19 (FIG. 13) in the end plate 12 of the movable scroll member 2, and an engaging portion 9"-2 extending integrally from the base portion 9"-1 and forming a truncated-cone shape, which is tapered from the root portion to the end portion. Similarly, each of the pins 10" is constructed of a base portion 10"-1 as a cylindrical column shape fitted to a corresponding recess 20 (FIG. 13) in the end wall 4***b* of the inner casing 4, and an engaging portion 10"-2 extending integrally from the base portion 10"-1 and forming a truncated-cone shape, which is tapered from the root portion to the tip end portion. These pairs of truncated-cone-shaped engaging portions 9"-2 and 10"-2 are in side-by-side contact on a line of length L in FIG. 16-A to generate a circumferential force for preventing the movable scroll member 2 rotating about its own axis as in the first embodiment.

In the thus constructed self-rotation-blocking mechanism in the sixth embodiment, the pins 9" are contacted with the corresponding pins 10" along a line of length L in FIG. 16-A, so that contact forces F, F' and F" are generated, providing component forces f, f' and f", for preventing the self rotating movement of the movable scroll member 2, as explained with reference to FIGS. 4-A and 4-B. In this case, the truncated-cone-shape portions 9"-2 and 10"-2 are in side-by-side contact along the entire line of length L in FIG. 16-A. Thus, along the line of length L, the diameter $r_1$ of the pin 9" and the diameter $r_2$ of the pin 10" are not identical, as shown in FIG. 15. However, due to the conical arrangement, the sum of the diameter $r_1$ and $r_2$ is always equal to the diameter r of the orbital movement of the movable scroll member 2.

In the sixth embodiment in FIGS. 13 to 15 and FIG. 16-A, the pins 9" and 10" function to receive not only the circumferential forces causing the movable scroll member 2 to be rotated about its own axis but also an axial thrust force. Namely, the movable scroll member 2 is prevented from being axially moved despite the compression reaction force due to the fact that the conical surfaces of the portions 9"-2 and 10"-2 engage in the axial direction.

The provision of the conical shaped portions on the pins 9" and 10" allow the diameter of the root portions to be increased, so that, with respect to the large bending moment, an increase in the stress at the root portions is suppressed. In the condition, for example, that the length of the pins is 5 mm, the radius r of the orbital movement of the movable scroll member 2 is 5 mm, and the tapering angle $\alpha$ of the conical shaped portion is 45°, the value of the maximum bending moment at the root portion of the pin 9" or 10" is one ninth when compared with the condition that the pins are of a circular cylindrical shape as is the case in the first embodiment. Additionally, the conical shape of the pins 9" and 10" is advantageous in that mounting the movable scroll member 2 to the casings 4 and 5 is eased.

FIG. 16-B shows a modification of the sixth embodiment, where the pins 9" and 10" extend axially so as to engage faced surfaces of the end wall 4*b* of the front casing and the end plates 12 of the movable scroll member, respectively, so that the axial thrust force generated in the movable scroll member is received from the pins by the opposed end surfaces.

As a further modification in the sixth embodiment, separate means, such as projecting portions 26 in FIG. 10, can be provided for generating an axial thrust force for axially supporting the movable scroll member 2.

FIGS. 17 and 18 show a seventh embodiment, wherein the construction of the scroll compressor is substantially the same as that shown in FIG. 1, except that the diameter of the pins 9 and 10 are different, although the same diameter construction may be also employed. However, unlike the first embodiment, desired gaps or clearances c, shown in FIG. 18, are provided between the pins 9 and 10 of each of six pairs of the pins. Such gaps are effective for preventing the pins 9 and 10 from being axially engaged when the movable scroll member 2, the casings 4 and 5, and the fixed scroll member 3 are assembled, thereby reducing problems in the assembly process. Furthermore, the provision of the gaps c is also effective for preventing the stress from being concentrated in a particular pair of the pins 9 and 10, thereby preventing these pins 9 from being damaged, during the operating of the compressor. In FIGS. 17 and 18, the gap c is of a small value which does not affect the desired function for preventing the self rotation of the movable scroll member 2, although the gap is shown exaggerated for purposes of explanation. Contrary to this, when such a clearance is not provided between the pins 9 and 10 as is the case in the first embodiment, a permissible error in the shape or dimension of the pins 9 and 10 or a position of the recess 19 in the end plate 12 of the movable scroll member 2 or the recess 20 at the end wall of the front casing may cause the pins 9 and 10 to be "end to end" engaged, when the movable scroll member 2, the casings 4 and 5, and the fixed scroll member 3 are assembled, thereby making it difficult to easily assemble the compressor. Furthermore, even if the compressor is assembled, an excessive load is generated at a particular location of a pin, thereby causing the part to be damaged.

The clearance c is expressed by the following equation, that is, $$c = r - \frac{d_1 + d_2}{2},$$

where the $d_1$ and $d_2$ are the diameter of the pins 9 and 10, respectively, and r is the radius of the orbital movement of the movable scroll member 2. A suitable value of the clearance c can allow the parts to be easily assembled even if the pins 9 and 10 are formed as cylindrical columns, thereby preventing the pins from being excessively loaded during the assembly process. However, the clearance is of a value such that the movable pin 9 can be engaged with the corresponding fixed pin 10, thereby generating a force for preventing the movable scroll member 2 from being rotated about its own axis. Namely, when the operation of the compressor commences, the pins 9 as well as the movable scroll member 2 are rotated, about the axis of the latter, through a very small angle until the pins 9 contact the corresponding pins 10, and the rotation of the movable scroll member 2 about its own axis is then blocked. In other words, the radius r of the orbital movement of the movable scroll member 2 is reduced due to the existence of the clearance c. Namely, the following equation, that is $$r > \frac{d_1 + d_2}{2},$$

is obtained for the compressor having the clearance c between the pins 9 and 10.

FIGS. 19-A and B, and 20 and 21 show an eighth embodiment, in which a follower-crank mechanism 28, of a variable eccentricity, is employed. Such a follower-crank mechanism is itself disclosed in the Japanese UnExamined Patent Publication No. 2-176179 and is constructed of a drive key 29 extending integrally from the end portion 1-1 of the drive shaft 1 at a location spaced from the axis thereof, and a bushing 30 having a driven groove 30*a*, to which the drive key 29 is radially slidably inserted. The movable scroll member is rotatably supported on the bushing 30. The bushing 30 is integrally formed with a balancing weight portion 30*b* at a location which can balance at least part of the centrifugal force which is generated when the drive shaft 1 is rotated. As shown in FIG. 19-B, the drive key 29 is formed with substantially circumferentially spaced planes 29-1 and 29-2, and the groove 30*a* is formed with substantially circumferentially spaced planes 30*a*-1 and 30*a*-2. The plane 29-1 of the driving key 29 engages the plane 30*a*-1 as a driven plane, while the plane 29-2 of the drive key engages with the plane 30*a*-2 of the groove 30*a*, so that the rotating movement of the drive shaft 1 as shown by an arrow M is transmitted to the bushing 30. As shown in FIG. 19-A, in the cross section transverse to the axis of the rotation, the planes of the driving key 29 and the groove 30*a* are inclined, with respect to the line Y connecting the axis Ck of the shaft 1 and the axis Cb of the bushing 30 (axis Cr of the movable scroll member 2), at an angle Θ in the direction M opposite to the direction of rotation of the shaft 1.

During the operating of the compressor, a compression reaction force Fp is generated in the direction transverse to the line Y connecting the axis of the movable scroll member and the axis of Ck of the drive shaft. As a result, a component force Fp×sin Θ is applied to the bushing 30 in the direction parallel to the planes, so that the bushing 30 is moved radially outwardly. As a result, the distance ϵ between the axis Cb of the bushing 30 and the axis Ck of the drive shaft 1 is increased, so that the movable scroll member 2 is also moved radially outwardly. As a result, the scroll portion 14 (FIG. 21) of the movable scroll member 2 is urged to be contacted with the scroll portion 17 of the fixed scroll member 3. Thus, effective sealing at the points of contact for creating the pump chambers 90 between the scroll portions 14 and 17 is obtained. In this case, the force $F_D$ acting between the scroll portions 14 and 17 produced by the compression reaction force Fp has a component $F_D$×COS Θ in the direction of the elongation of the drive key 29 and a component $F_e$×sin Θ in the direction of transverse to the elongation of the drive key 29. Furthermore, the first component is equal to the component of the compression force in the direction of the elongation of the drive key 29, and thus the following equation, $$F_D \times \cos\Theta = Fp \times \sin\Theta$$

is obtained. Thus, the force for urging the scroll portions 14 and 17 to contact with each other is expressed by the following equation.

$$F_D = Fp \times \tan\Theta$$

In view of the above, according to the eighth embodiment, the use of the crank mechanism 28 capable of varying the amount ϵ of the eccentricity between the movable scroll member 2 and the bushing 30 can vary the pressing force $F_D$ between the scroll portions 14 and 17 of the scroll members 2 and 3, respectively in accordance with the value of the compression reaction force Fp, thereby obtaining an idealized sealing condition of the pump chambers 90, thereby increasing the compression efficiency of the scroll compressor.

In the scroll compressor with the follower-crank mechanism 28 in the eighth embodiment, the degree ϵ of the eccentricity is variable. When the target value of the degree ϵ of the eccentricity or the radius r of the orbital movement is $\epsilon_0$, the setting expressed by the following equation, $$\epsilon_0 > \frac{d_1 + d_2}{2},$$

is advantageous. Namely, a gap larger than a predetermined value normally exists between the scroll portions 14 and 17 of the scroll members 2 and 3, which makes it easy for the movable scroll member 2 to be assembled, since the opposite pins 9 and 10 are prevented from being axially engaged.

FIG. 20 illustrates an operation of the pins 9 and 10 of the self rotation blocking mechanism in the scroll compressor in the eighth embodiment. In FIG. 20, the direction of the self rotating torque is shown by M (clockwise direction), and the direction of the orbital movement is also expressed by M. For the same reason as given with reference to FIGS. 4-A and 4-B, only between the pins located on the left-hand half, forces $F_1$, $F_2$ and $F_3$ are generated. As a result, at the center $C_b$ of the bushing 30, a reaction force $\Delta F_D'$ that is, $$\Delta F_D' = F_1 + F_2 + F_3,$$

is generated. This reaction force $\Delta F_D'$ is in a direction for causing the scroll portion 14 (FIG. 21) of the movable scroll member 2 to be contacted with the scroll portion 17 of the fixed scroll member 3. In other words, the pressing force $F_D$ is increased for an amount of $\Delta F_D'$, thereby obtaining an increased sealing effect between the pump chambers 90.

FIGS. 22 to 29 show a ninth embodiment of the present invention, in which the pitch circle $R_9$ and $R_{10}$ of the pins 9 and 10, respectively, are eccentric by an amount δ as shown in FIG. 22 or 23 with respect to the centers $C_r$ and $C_k$, respectively, thereby reducing the load applied to the pins. FIG. 24 shows the relationship between an angular position and a self rotation torque in the movable scroll member 2. As will be understood, a peak and a valley appear alternately for every 180 degrees of rotation. In other words, the peak appears for every 360 degrees of rotation. The peak value is determined by the compression ratio, which is equal to the discharge pressure $P_d$ divided by the intake pressure $P_S$. In FIG. 24, a curve a is produced when the ratio $$\frac{P_d}{P_s}$$

is 10.0 kgf/cm$^2$, while a curve b is produced when the ratio $$\frac{P_d}{P_s}$$

is 5.3 kgf/cm$^2$.

FIGS. 25 to 28 illustrate the relationship between the scroll portion 14 of the movable scroll member 2 and the scroll portion 17 of the fixed scroll member 3 for various phases of the operation of the scroll compressor. FIG. 25 shows the condition, when the rotating angle is zero degree, where the outermost pump chamber 90 is just closed at both ends to commence compression, while compression continues in the inner pump chambers thereby obtaining the minimum value of the self-rotation torque as shown in FIG. 24. FIG. 26 is the condition where the angle is 90 degrees, the compression is continuing in the chambers 90, and the self-rotation torque is increasing. FIG. 27 is the condition where the angle is 180 degrees, the innermost chamber is just about to open to the outlet port 8, and self rotating torque is a maximum as shown in FIG. 24. FIG. 28 is a condition where the rotattng angle is 270 degrees, the innermost pump chamber is still open to the outlet port 8, the outer most pump chamber is not yet closed, and the self-rotation torque is decreasing.

FIG. 22 shows a positional relationship between the pins 9 and 10 when the rotating angle is about 180 degrees in FIG. 27. At this rotating angle, the maximum value of self rotation torque in the movable scroll member 2 is obtained, as shown in FIG. 24. As explained above, the pins 9 on the end plate of the movable scroll member are located on the pitch circle $R_9$ centered on the center $C_9$, which is offset by an amount δ from the axis $C_r$ of the boss portion of the movable scroll member, while the pins 10 on the end wall of the front casing are located on the pitch circle $R_{10}$ centered on the center $C_{10}$, which is offset by an amount δ from the axis $C_k$ of the drive shaft. The construction of the ninth embodiment is different from the construction of the first embodiment, where the center $C_r$ of the pitch circle $R_r$ of the pins 9 conforms to the axis of the movable scroll member, and the center $C_k$ of the pitch circle $R_k$ of the pins 10 conforms to the axis $C_k$ of the drive shaft.

In FIG. 22, the self rotation torque urges tne movable scroll member 2 to be rotated in the same direction as that of the orbital movement. However, this self-rotation torque is, at its maximum as shown in FIG. 22, also, received by the pins 9 located on the right-hand side of the line Y connecting the centers $C_r$ and $C_k$, due to the fact that these pins 9 engage the respective pins 10 in the direction for blocking the self rotation. In this case, the further the pins 9 and 10 are spaced from the centers $C_r$ and $C_k$, the longer is the radius of the moment of the rotation, so that, with respect to the same self-rotating torque, the load on the pins 9 and 10, which are in a contacting relationship, is reduced. In view of this, an eccentric arrangement of the center $C_9$ of the pitch circle $R_9$ and the center $C_{10}$ of the pitch circle $R_{10}$ with respect to the line Y connecting the center $C_r$ of the rotation of the movable scroll member and the center $C_k$ of the rotation of the shaft is employed in the direction transverse to the line Y. This arrangement can not only increase the length of the arm of the moment but also can increase the number of the pairs of pins 9 and 10 located on the right-hand side of the line Y, thereby reducing the load on each of the pins. In FIG. 22, the pair of the pins indicated by 9X and 10X provide a full-contact force in the direction opposite to the self-rotation torque, as do the pins **9*b* and 10*b* in FIG. 4-A, and an arrangement is preferable such that the pin 9X is located on a line Z1 connecting the centers $C_r$ and $C_9$, while the paired pin 10X is located on a line Z2** connecting the centers Ck and $C_{10}$. As a result of this construction, a maximum length of the arm is obtained when the force for blocking the self-rotation is the maximum, thereby reducing the load in the pins.

FIG. 23 shows the condition, where the movable scroll member is rotated 180 degrees from the position in FIG. 22, and where, as shown in FIG. 24, the self rotating torque becomes the minimum. In this condition, the pair of pins 9 and 10 located on the left-hand side of the line Y function to receive the load caused by the self-rotation torque in the movable scroll member 2 in the direction shown by an arrow. In this case, the distance from the centers $C_r$ and $C_k$ to the pins 9 and 10, located on the left-hand side in FIG. 23 and functioning to receive the self rotation torque, is reduced to the minimum value. However, the value of the self-rotation torque is itself small, and therefore, the small value of the arm of the moment is sufficient to receive the reduced self-rotation torque.

In short, in the ninth embodiment, the length of the arm of the moment from the centers $C_r$ and $C_k$ to the pins 9 and 10 functioning to receive the self-rotation torque is varied in accordance with the value of the self-rotation torque in such a manner that the length of the arm of the moment is the maximum value when the maximum value of the self-rotation torque is generated.

FIG. 29 shows a tenth embodiment, where the pairs of pins 9 and 10 are arranged to be locally concentrated in such a manner that the numbers of the pins 9 and 10, functioning to create the forces opposing the self rotation torque, are increased at an angular position (α=180° in FIG. 27), where the self-rotation torque is high. As explained, when a self-rotation torque M in a clockwise direction is applied to the movable scroll member 2, only the movable pins 9 located on the right-hand side of the line Y can contact the corresponding fixed pins 10 to block self-rotation. FIG. 29 shows a condition where the maximum self-rotation torque is applied to the movable scroll member 2. In this case, a locally concentrated arrangement of the pairs of pins 9 and 10 on the pitch circles Rr and Rk is obtained so that the number (four) of the pairs of pins 9 and 10 located on the right-hand side, which generate force in the direction opposite to the self-rotation torque, is larger than the number of pairs (two) of the pins 9 and 10 located on the left-hand side, which do not generate a force opposite to the self-rotation torque.

According to the tenth embodiment, in an increased self-rotation torque condition, an increased number of pairs of pins, that can generate forces opposite to the self-rotation torque, is obtained, thereby giving an effective self rotation blocking function and reducing the load applied to the pins. Thus, the diameter of the pins 9 and 10, as well as the number of the pairs of the pins, can be reduced, thereby reducing the dimensions, weight and manufacturing cost of the compressor.

FIG. 30 shows an eleventh embodiment which is a combination of the offset arrangement of the centers C9 and C10 on the pitch circles in FIGS. 22 to 28 (ninth embodiment) and the locally concentrated arrangement of the pairs of the pins in FIG. 29 (tenth embodiment). Namely, as in the ninth embodiment in FIGS. 22 to 28, the offset arrangement of the center C9 and C10 of the circles R9 and R10 of the pins 9 and 10 is employed with respect to the axis of the movable scroll member Cr and the axis Ck of the drive shaft, in such a manner that, at the maximum self-rotation torque position as shown in FIG. 30, an increased length of the arm of the moment obtained by the amount corresponding to the value of the eccentricity δ. Furthermore, as in the tenth embodiment in FIG. 29, a locally concentrated arrangement of the pairs of pins 9 and 10 is obtained. Namely, in the maximum self-rotation torque position in FIG. 30, an increased number of pairs of the pins 9 and 10 which can generate a force in the direction of the self-rotation torque is obtained in comparison with the number of the pairs of the pins 9 and 10 which can not generate such a force.

According to the present invention, the pins 9 and 10 are not necessarily arranged on pitch circles Rr and Rk, respectively or R9 and R10, respectively. Namely, the pins 9 and 10 can be arranged on desired curves, so long as a condition is maintained that, at every angular position, there exists at least one pair of the pins 9 and 10 in their contact condition so as to provide forces in a direction opposite to the self-rotation torque. Furthermore, in accordance with the concept of the ninth to eleventh embodiment, a locally concentrated arrangement of the pairs of pins is desirable so that, in an increased self-rotation torque condition, an increased number of the pairs of pins, which generate force in the direction opposite the self rotation torque, is obtained.

While embodiments of the present invention are described with respect to the attached drawings, many modification and changes can be made by those skilled in this art without departing from the scope and spirit of the present invention.

We claim:

1. A scroll compressor comprising:

a casing;

a drive shaft rotatably supported on the casing;

a fixed scroll member arranged in and fixed to the casing;

a movable scroll member movably arranged in the casing;

said scroll members having scroll portions which are arranged in a side-by-side relationship in a radial direction so that radially spaced chambers are created;

a crank member which is connected to the drive shaft at a location spaced from an axis of the drive shaft;

the movable scroll member being connected rotatably to the crank member, so as to obtain an orbital movement of the movable scroll member about an axis of the drive shaft, so that said radially spaced chambers move radially inwardly, while volumes of the chambers are reduced;

inlet means for introducing a medium to be compressed into a radially outwardmost one of the chambers;

outlet means for discharging the medium as compressed from a radially innermost one of the chambers;

a plurality of circumferentially spaced first pins mounted on the movable scroll member, so that the first pins extend axially away from the scroll portion; and a plurality of circumferentially spaced second pins mounted on the casing, so that the second pins extend axially toward the movable scroll member;

dimensions of the first and second pins with respect to the radius of the orbital movement of the movable scroll member being such that the first and second pins are capable of being in side by side contact with each other, while the first pins are rotated about the respective second pins during the orbital movement of the movable scroll member, each of the first pins being unrestricted in movement in a direction radially away from an associated one of the second pins;

an arrangement of the first and second pins on the movable scroll member and the casing, respectively, is such that there exists, at every angular position of the movable scroll member, at least one pair of the first and second pins, which generates a force in a direction opposite to a direction of self-rotation of the movable scroll member, thereby preventing the movable scroll member from rotating about its own axis.

2. A scroll compressor according to claim 1, wherein a half of a sum of the diameters of the first pin and the second pin is substantially equal to a radius of the orbital movement of the movable scroll member.

3. A scroll compressor according to claim 1, wherein a half of a sum of the diameters of the first pin and the second pin is smaller than a radius of the orbital movement of the movable scroll member, so that a gap exists between the first and second pin, but allowing the first and second pins to contact each other during the orbital movement of the movable scroll member.

4. A scroll compressor according to claim 1, wherein said first pins are connected rotatably to said movable scroll member.

5. A scroll compressor according to claim 1, wherein said second pins are connected rotatably to said casing.

6. A scroll compressor according to claim 1, wherein said first and second pins are arranged with respect to said casing and the movable scroll member such that an axial thrust force on the movable scroll member, caused by a compression reaction force in said chambers, is supported.

7. A scroll compressor according to claim 1, wherein said first and second pins are arranged so that they are prevented from being in axial contact with the casing and the movable scroll member, respectively, and said scroll compressor further comprises separate means for receiving an axial thrust force on the movable scroll member caused by a compression reaction force in said chambers.

8. A scroll compressor according to claim 7, wherein said thrust receiving means comprises a plurality of projecting portions formed on the movable scroll member so that they axially project to contact with a faced surface of the casing, thereby receiving the thrust force.

9. A scroll compressor according to claim 8, wherein said projected portions are arranged between the first pins which are circumferentially adjacent with each other.

10. A scroll compressor according to claim 7, wherein said casing has, at a surface facing the first pins, a circumferentially spaced recess for allowing the first pins to be rotated about the corresponding second pins during the orbital movement of the movable scroll member.

11. A scroll compressor according to claim 7, further comprising a ring shaped plate member fixedly connected to said casing, the plate member having, at a surface the first pins, circumferentially spaced cut-out portions for allowing the first pins to be rotated about the corresponding second pins during the orbital movement of the movable scroll member.

12. A scroll compressor according to claim 1, wherein said first and second pins form a cylindrical pillar shape.

13. A scroll compressor according to claim 1, wherein said first and second pins have conical surfaces tapered towards their distal ends.

14. A scroll compressor according to claim 1, wherein said first pins are arranged on a pitch circle about the axis of the movable scroll member, while said second pins are arranged on a pitch circle about the axis of the drive shaft.

15. A scroll compressor according to claim 14, wherein the arrangement of said first and the second pins along the corresponding pitch circles is such that an equal spacing between adjacent pins is obtained.

16. A scroll compressor according to claim 1, wherein a circumferential arrangement of the pairs of the first and second pins, which are in contact with each other, is such that, at an angular position of the movable scroll member providing the maximum value of a self-rotating torque, the number of the pairs of pins which generate forces in the direction opposite to the self-rotation torque of the movable scroll member is larger than the number of the pairs which cannot generate such a force.

17. A scroll compressor according to claim 1, wherein a circumferential arrangement of the first and second pins with respect to the axis of the movable scroll member and the axis of the drive shaft is such that the distances from the axis of the movable scroll member and the drive shaft to paired first and second pins, respectively, providing the force opposing the self-rotation torque at an angular position of the movable scroll member providing a large value of self-rotating torque is larger than the distances from the axis of the movable scroll member and the drive shaft to a pair of first and second pins providing a force opposing the self-rotation torque at an angular position of the movable scroll member providing a small value of self-rotating torque.

18. A scroll compressor according to claim 1, wherein the first pins are arranged on pitch circle, while the second pins are arranged on another pitch circle, the centers of the pitch circles of the first and second pins are offset from the centers of the movable scroll member and the casing in such a manner that, at an angular position of the movable scroll member providing the maximum value of the self-rotating torque of the movable scroll member, the centers of the pitch circles of the first and the second pins are located to the side of the axis of the scroll members and the drive shaft, respectively, which are adjacent the first and second pins, respectively, which are in positions for receiving the force in the direction opposite to the self-rotation torque.

19. A scroll compressor comprising:

a casing;

a drive shaft rotatably supported on the casing;

a fixed scroll member arranged in and fixed to the casing;

a movable scroll member movably arranged in the casing;

said scroll members having scroll portions which are arranged in a side-by-side relationship in a radial direction so that radially spaced chambers are created;

a drive key fixedly connected to the drive shaft at a location spaced from an axis of the drive shaft;

a bushing on which the movable scroll member is rotatably mounted, the bushing defining a groove which receives said drive key, so as to obtain an orbital movement of the bushing about an axis of the drive shaft, so that said radially spaced chambers move radially inwardly, while volumes of the chambers are reduced;

the drive key having a rotating force transmission radial plane extending parallel to the axis of the drive shaft, while the groove defines a rotating force receiving radial plane extending parallel to the axis of the drive shaft, these planes contacting with each other while allowing the drive key to be radially slidable in the groove, the planes being, in a cross section transverse to the axis of the shaft, inclined with respect to the line connecting the axis of the movable scroll member and the axis of the drive shaft opposite to the direction of the rotation of the drive shaft;

inlet means for introducing a medium to be compressed into a radially outwardmost one of the chambers;

outlet means for discharging the medium as compressed from a radially innermost one of the chambers;

a plurality of circumferentially spaced first pins mounted onto the movable scroll member, so that the first pins extend axially away from the scroll portion, and;

a plurality of circumferentially spaced second pins mounted onto the casing, so that the second pins extend axially toward the movable scroll member;

the dimensions of the first and second pins with respect to the radius of the orbital movement of the movable scroll member being such that the first and second pins can be in side-by-side contact with each other while the first pins are rotated about the respective second pins during the orbital movement of the movable scroll member;

the arrangement of the first and second pins on the movable scroll member and the casing, respectively, is such that there exist, at every angular position of the movable scroll member, at least one pair of the first and second pins which generates a force in a direction opposite to the direction of the self-rotation of the movable scroll member, thereby preventing the movable scroll member from being rotated about its own axis.

* * * * *